US010953268B1

(12) United States Patent
Dalebout et al.

(10) Patent No.: US 10,953,268 B1
(45) **Date of Patent: *Mar. 23, 2021**

(54) STRENGTH TRAINING APPARATUS

(71) Applicant: ICON Health & Fitness, Inc., Logan, UT (US)

(72) Inventors: William Dalebout, North Logan, UT (US); Michael Olson, Providence, UT (US)

(73) Assignee: ICON HEALTH & FITNESS, INC., Logan, UT (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/115,708

(22) Filed: Dec. 8, 2020

Related U.S. Application Data

(63) Continuation of application No. 16/923,275, filed on Jul. 8, 2020, which is a continuation of application
(Continued)

(51) Int. Cl.
*A63B 21/22* (2006.01)
*A63B 21/00* (2006.01)
(Continued)

(52) U.S. Cl.
CPC ..... *A63B 21/225* (2013.01); *A63B 21/005* (2013.01); *A63B 21/0051* (2013.01);
(Continued)

(58) Field of Classification Search
CPC ..... A63B 21/225; A63B 24/0087; A63B 24/0062; A63B 21/151; A63B 21/4047;
(Continued)

(56) References Cited

U.S. PATENT DOCUMENTS 3,123,646 A 3/1964 Easton
3,579,339 A 5/1971 Chang
(Continued)

FOREIGN PATENT DOCUMENTS

CN 2172137 Y 7/1994
CN 2291169 Y 6/1998
(Continued)

OTHER PUBLICATIONS

U.S. Appl. No. 61/920,834, filed Dec. 26, 2013, titled "Magnetic Resistance Mechanism in a Cable Machine", 31 pages.
(Continued)

*Primary Examiner* — Andrew S Lo
(74) *Attorney, Agent, or Firm* — Maschoff Brennan

(57) ABSTRACT

Embodiments of a strength training apparatus and related methods are provided. In one embodiment, a strength training apparatus may include a first arm and a second arm each being configured to be selectively pivoted independent of each other at multiple angles relative to each other, a first pulley coupled to an end of the first arm, a first cable extending through the first arm and the first pulley, a second pulley coupled to an end of the second arm, a second cable extending through the second arm and the second pulley, and an electronic control panel configured to allow for multiple levels of resistance to a user pulling on the first cable and/or the second cable. The electronic control panel may include a processor and a memory configured to control a current level of resistance, an electronic input device configured to allow the user to set the current level of resistance, and an electronic output device configured to display the current level of resistance.

68 Claims, 7 Drawing Sheets

Related U.S. Application Data

No. 16/404,413, filed on May 6, 2019, now Pat. No. 10,709,925, which is a continuation of application No. 15/472,954, filed on Mar. 29, 2017, now Pat. No. 10,279,212, which is a continuation of application No. 15/019,088, filed on Feb. 9, 2016, now Pat. No. 9,616,276, which is a continuation of application No. 14/213,793, filed on Mar. 14, 2014, now Pat. No. 9,254,409.

(60) Provisional application No. 61/786,007, filed on Mar. 14, 2013.

(51) Int. Cl.

| | |
|---|---|
| ***A63B 21/005*** | (2006.01) |
| ***A63B 21/04*** | (2006.01) |
| ***A63B 23/035*** | (2006.01) |
| ***A63B 23/12*** | (2006.01) |
| ***A63B 24/00*** | (2006.01) |
| ***A63B 71/06*** | (2006.01) |

(52) U.S. Cl.

CPC .... *A63B 21/0052* (2013.01); *A63B 21/00076* (2013.01); *A63B 21/00192* (2013.01); *A63B 21/0442* (2013.01); *A63B 21/151* (2013.01); *A63B 21/154* (2013.01); *A63B 21/156* (2013.01); *A63B 21/4035* (2015.10); *A63B 21/4043* (2015.10); *A63B 21/4047* (2015.10); *A63B 21/4049* (2015.10); *A63B 23/03525* (2013.01); *A63B 23/03533* (2013.01); *A63B 23/03541* (2013.01); *A63B 23/12* (2013.01); *A63B 23/1209* (2013.01); *A63B 23/1218* (2013.01); *A63B 23/1227* (2013.01); *A63B 24/0062* (2013.01); *A63B 24/0087* (2013.01); *A63B 21/0056* (2013.01); *A63B 2024/0065* (2013.01); *A63B 2024/0093* (2013.01); *A63B 2071/0625* (2013.01); *A63B 2071/0675* (2013.01); *A63B 2071/0694* (2013.01); *A63B 2220/54* (2013.01); *A63B 2220/833* (2013.01); *A63B 2225/09* (2013.01)

(58) Field of Classification Search

CPC ..... A63B 21/005; A63B 23/03525; A63B 21/0051; A63B 21/00192; A63B 23/12; A63B 21/4035; A63B 21/4043; A63B 21/4049; A63B 21/1227; A63B 23/1218; A63B 23/1209; A63B 23/03541; A63B 23/03533; A63B 12/156; A63B 21/154; A63B 21/0442; A63B 21/0052; A63B 21/00076; A63B 21/0056; A63B 2071/0625; A63B 2024/0093; A63B 2225/09; A63B 2220/833; A63B 2220/54; A63B 2071/0694; A63B 2071/0675; A63B 2024/0065

See application file for complete search history.

(56) References Cited

U.S. PATENT DOCUMENTS

| | | | |
|---|---|---|---|
| 3,926,430 | A | 12/1975 | Good, Jr. |
| 4,023,795 | A | 5/1977 | Pauls |
| 4,300,760 | A | 11/1981 | Bobroff |
| 4,413,821 | A | 11/1983 | Centafanti |
| 4,533,136 | A | 8/1985 | Smith et al. |
| D286,311 | S | 10/1986 | Martinell et al. |
| 4,681,318 | A | 7/1987 | Lay |
| 4,684,126 | A | 8/1987 | Dalebout et al. |
| 4,705,028 | A | 11/1987 | Melby |
| 4,725,057 | A | 2/1988 | Shifferaw |
| 4,728,102 | A | 3/1988 | Pauls |
| 4,750,736 | A | 6/1988 | Watterson |
| 4,796,881 | A | 1/1989 | Watterson |
| 4,813,667 | A | 3/1989 | Watterson |
| 4,830,371 | A | 5/1989 | Lay |
| 4,844,451 | A | 7/1989 | Bersonnet et al. |
| 4,850,585 | A | 7/1989 | Dalebout |
| D304,849 | S | 11/1989 | Watterson |
| 4,880,225 | A | 11/1989 | Lucas et al. |
| 4,883,272 | A | 11/1989 | Lay |
| D306,468 | S | 3/1990 | Watterson |
| D306,891 | S | 3/1990 | Watterson |
| 4,913,396 | A | 4/1990 | Dalebout et al. |
| D307,614 | S | 5/1990 | Bingham et al. |
| D307,615 | S | 5/1990 | Bingham et al. |
| 4,921,242 | A | 5/1990 | Watterson |
| 4,932,650 | A | 6/1990 | Bingham et al. |
| D309,167 | S | 7/1990 | Griffin |
| D309,485 | S | 7/1990 | Bingham et al. |
| 4,938,478 | A | 7/1990 | Lay |
| D310,253 | S | 8/1990 | Bersonnet et al. |
| 4,955,599 | A | 9/1990 | Bersonnet et al. |
| 4,968,028 | A | 11/1990 | Wehrell |
| 4,971,316 | A | 11/1990 | Dalebout et al. |
| D313,055 | S | 12/1990 | Watterson |
| 4,974,832 | A | 12/1990 | Dalebout |
| 4,979,737 | A | 12/1990 | Kock |
| 4,981,294 | A | 1/1991 | Dalebout et al. |
| 5,000,442 | A | 1/1991 | Dalebout et al. |
| D315,765 | S | 3/1991 | Measom et al. |
| 4,998,725 | A | 3/1991 | Watterson et al. |
| 5,000,443 | A | 3/1991 | Dalebout et al. |
| 5,000,444 | A | 3/1991 | Dalebout et al. |
| D316,124 | S | 4/1991 | Dalebout et al. |
| 5,013,033 | A | 5/1991 | Watterson et al. |
| 5,014,980 | A | 5/1991 | Bersonnet et al. |
| 5,016,871 | A | 5/1991 | Dalebout et al. |
| D318,085 | S | 7/1991 | Jacobson et al. |
| D318,086 | S | 7/1991 | Bingham et al. |
| D318,699 | S | 7/1991 | Jacobson et al. |
| 5,029,801 | A | 7/1991 | Dalebout et al. |
| 5,034,576 | A | 7/1991 | Dalebout et al. |
| 5,039,091 | A | 8/1991 | Johnson |
| 5,058,881 | A | 10/1991 | Measom |
| 5,058,882 | A | 10/1991 | Dalebout et al. |
| D321,388 | S | 11/1991 | Dalebout |
| 5,062,626 | A | 11/1991 | Dalebout et al. |
| 5,062,627 | A | 11/1991 | Bingham |
| 5,062,632 | A | 11/1991 | Dalebout et al. |
| 5,062,633 | A | 11/1991 | Engel et al. |
| 5,067,710 | A | 11/1991 | Watterson et al. |
| 5,072,929 | A | 12/1991 | Peterson et al. |
| D323,009 | S | 1/1992 | Dalebout et al. |
| D323,198 | S | 1/1992 | Dalebout et al. |
| D323,199 | S | 1/1992 | Dalebout et al. |
| D323,863 | S | 2/1992 | Watterson |
| 5,088,729 | A | 2/1992 | Dalebout |
| 5,090,694 | A | 2/1992 | Pauls et al. |
| 5,102,380 | A | 4/1992 | Jacobson et al. |
| 5,104,120 | A | 4/1992 | Watterson et al. |
| 5,108,093 | A | 4/1992 | Watterson |
| D326,491 | S | 5/1992 | Dalebout |
| 5,122,105 | A | 6/1992 | Engel et al. |
| 5,135,216 | A | 8/1992 | Bingham et al. |
| 5,135,458 | A | 8/1992 | Huang |
| 5,147,265 | A | 9/1992 | Pauls et al. |
| 5,149,084 | A | 9/1992 | Dalebout et al. |
| 5,149,312 | A | 9/1992 | Croft et al. |
| 5,158,520 | A | 10/1992 | Lemke |
| 5,171,196 | A | 12/1992 | Lynch |
| D332,347 | S | 1/1993 | Raadt et al. |
| 5,190,505 | A | 3/1993 | Dalebout et al. |
| 5,192,255 | A | 3/1993 | Dalebout et al. |
| 5,195,937 | A | 3/1993 | Engel et al. |
| 5,203,826 | A | 4/1993 | Dalebout |
| D335,511 | S | 5/1993 | Engel et al. |
| D335,905 | S | 5/1993 | Cutter et al. |
| D336,498 | S | 6/1993 | Engel et al. |

(56) References Cited

U.S. PATENT DOCUMENTS 5,217,487 A 6/1993 Engel et al.
D337,361 S 7/1993 Engel et al.
D337,666 S 7/1993 Peterson et al.
D337,799 S 7/1993 Cutter et al.
5,226,866 A 7/1993 Engel et al.
5,242,339 A 9/1993 Thornton
5,244,446 A 9/1993 Engel et al.
5,247,853 A 9/1993 Dalebout
5,259,611 A 11/1993 Dalebout et al.
D342,106 S 12/1993 Campbell et al.
5,279,528 A 1/1994 Dalebout et al.
D344,112 S 2/1994 Smith
D344,557 S 2/1994 Ashby
5,282,776 A 2/1994 Dalebout
5,286,243 A 2/1994 Lapcevic
5,295,931 A 3/1994 Dreibelbis et al.
5,302,161 A 4/1994 Loubert et al.
D347,251 S 5/1994 Dreibelbis et al.
5,316,534 A 5/1994 Dalebout et al.
D348,493 S 7/1994 Ashby
D348,494 S 7/1994 Ashby
5,328,164 A 7/1994 Soga
D349,931 S 8/1994 Bostic et al.
5,336,142 A 8/1994 Dalebout et al.
5,344,376 A 9/1994 Bostic et al.
D351,202 S 10/1994 Bingham
D351,435 S 10/1994 Peterson et al.
D351,633 S 10/1994 Bingham
5,354,252 A 10/1994 Habing
D352,534 S 11/1994 Dreibelbis et al.
D352,536 S 11/1994 Byrd et al.
5,362,298 A 11/1994 Brown
D353,422 S 12/1994 Bostic et al.
5,372,559 A 12/1994 Dalebout et al.
5,374,228 A 12/1994 Buisman et al.
5,382,221 A 1/1995 Hsu et al.
5,385,520 A 1/1995 Lepine
5,387,168 A 2/1995 Bostic
5,393,690 A 2/1995 Fu et al.
D356,128 S 3/1995 Smith et al.
5,409,435 A 4/1995 Daniels
5,429,563 A 7/1995 Engel et al.
5,431,612 A 7/1995 Holden
D360,915 S 8/1995 Bostic et al.
5,468,205 A 11/1995 McFall et al.
5,484,358 A 1/1996 Wang et al.
5,489,249 A 2/1996 Brewer et al.
5,492,517 A 2/1996 Bostic et al.
D367,689 S 3/1996 Wilkinson et al.
5,511,740 A 4/1996 Loubert et al.
5,512,025 A 4/1996 Dalebout et al.
D370,949 S 6/1996 Furner
D371,176 S 6/1996 Furner
5,527,245 A 6/1996 Dalebout et al.
5,529,553 A 6/1996 Finlayson
5,540,429 A 7/1996 Dalebout et al.
5,549,533 A 8/1996 Olson et al.
5,554,085 A 9/1996 Dalebout
5,569,128 A 10/1996 Dalebout
5,588,938 A 12/1996 Schnider et al.
5,591,105 A 1/1997 Dalebout et al.
5,591,106 A 1/1997 Dalebout et al.
5,595,556 A 1/1997 Dalebout et al.
5,607,375 A 3/1997 Dalebout
5,611,539 A 3/1997 Watterson
5,622,527 A 4/1997 Watterson et al.
5,626,538 A 5/1997 Dalebout et al.
5,626,540 A 5/1997 Hall
5,626,542 A 5/1997 Dalebout et al.
D380,024 S 6/1997 Novak et al.
5,637,059 A 6/1997 Dalebout
D380,509 S 7/1997 Wilkinson et al.
5,643,153 A 7/1997 Nylen et al.
5,645,509 A 7/1997 Brewer et al.
D384,118 S 9/1997 Deblauw
5,662,557 A 9/1997 Watterson et al.
5,667,461 A 9/1997 Hall
5,669,857 A 9/1997 Watterson et al.
5,672,140 A 9/1997 Watterson et al.
5,674,156 A 10/1997 Watterson et al.
5,674,453 A 10/1997 Watterson et al.
5,676,624 A 10/1997 Watterson et al.
5,683,331 A 11/1997 Dalebout
5,683,332 A 11/1997 Watterson et al.
D387,825 S 12/1997 Fleck et al.
5,695,433 A 12/1997 Buisman
5,695,434 A 12/1997 Dalebout et al.
5,695,435 A 12/1997 Watterson et al.
5,702,325 A 12/1997 Watterson et al.
5,704,879 A 1/1998 Watterson et al.
5,718,657 A 2/1998 Dalebout et al.
5,720,200 A 2/1998 Anderson et al.
5,720,698 A 2/1998 Dalebout et al.
D392,006 S 3/1998 Dalebout et al.
5,722,922 A 3/1998 Watterson et al.
5,733,229 A 3/1998 Dalebout et al.
5,743,833 A 4/1998 Watterson et al.
5,762,584 A 6/1998 Daniels
5,762,587 A 6/1998 Dalebout et al.
5,772,560 A 6/1998 Watterson et al.
5,810,698 A 9/1998 Hullett et al.
5,827,155 A 10/1998 Jensen
5,830,113 A 11/1998 Coody et al.
5,830,114 A 11/1998 Halfen et al.
5,860,893 A 1/1999 Watterson et al.
5,860,894 A 1/1999 Dalebout et al.
5,899,834 A 5/1999 Dalebout et al.
5,921,892 A 7/1999 Easton
D412,953 S 8/1999 Armstrong
D413,948 S 9/1999 Dalebout
5,951,441 A 9/1999 Dalebout
5,951,448 A 9/1999 Bolland
D416,596 S 11/1999 Armstrong
6,003,166 A 12/1999 Hald et al.
6,019,710 A 2/2000 Dalebout et al.
6,027,429 A 2/2000 Daniels
6,030,320 A 2/2000 Stearns et al.
6,030,321 A 2/2000 Fuentes
6,033,347 A 3/2000 Dalebout et al.
D425,940 S 5/2000 Halfen et al.
6,059,692 A 5/2000 Hickman
D428,949 S 8/2000 Simonson
6,113,519 A 9/2000 Goto
6,123,646 A 9/2000 Colassi
6,123,649 A 9/2000 Lee et al.
6,171,217 B1 1/2001 Cutler
6,171,219 B1 1/2001 Simonson
6,174,267 B1 1/2001 Dalebout
6,193,631 B1 2/2001 Hickman
6,228,003 B1 5/2001 Hald et al.
6,238,323 B1 5/2001 Simonson
6,251,052 B1 6/2001 Simonson
6,261,022 B1 7/2001 Dalebout et al.
6,280,362 B1 8/2001 Dalebout et al.
6,296,594 B1 10/2001 Simonson
D450,872 S 11/2001 Dalebout et al.
6,312,363 B1 11/2001 Watterson et al.
D452,338 S 12/2001 Dalebout et al.
D453,543 S 2/2002 Cutler
D453,948 S 2/2002 Cutler
6,350,218 B1 2/2002 Dalebout et al.
D457,580 S 5/2002 Webber
6,387,020 B1 5/2002 Simonson
6,413,191 B1 7/2002 Harris et al.
6,422,980 B1 7/2002 Simonson
6,436,008 B1 8/2002 Skowronski et al.
6,447,424 B1 9/2002 Ashby et al.
6,454,679 B1 9/2002 Radow
6,458,060 B1 10/2002 Watterson et al.
6,458,061 B2 10/2002 Simonson
6,471,622 B1 10/2002 Hammer et al.
6,488,612 B2 12/2002 Sechrest
6,491,610 B1 12/2002 Henn
6,506,142 B2 1/2003 Itoh

(56) References Cited

U.S. PATENT DOCUMENTS 6,527,678 B1 3/2003 Wang
6,547,698 B2 4/2003 Inagawa
6,563,225 B2 5/2003 Soga et al.
6,599,223 B2 7/2003 Wang
6,601,016 B1 7/2003 Brown et al.
6,623,140 B2 9/2003 Watterson
6,626,799 B2 9/2003 Watterson et al.
6,652,424 B2 11/2003 Dalebout
6,669,607 B2 12/2003 Slawinski
6,685,607 B1 2/2004 Olson
6,695,581 B2 2/2004 Wasson et al.
6,699,159 B2 3/2004 Rouse
6,701,271 B2 3/2004 Willner et al.
6,702,719 B1 3/2004 Brown et al.
6,712,740 B2 3/2004 Simonson
6,719,667 B2 4/2004 Wong
6,730,002 B2 5/2004 Hald et al.
6,743,153 B2 6/2004 Watterson et al.
6,746,371 B1 6/2004 Brown et al.
6,749,537 B1 6/2004 Hickman
6,761,667 B1 7/2004 Cutler et al.
6,770,015 B2 8/2004 Simonson
6,783,482 B2 8/2004 Oglesby
6,786,852 B2 9/2004 Watterson et al.
6,796,925 B2 9/2004 Martinez
6,808,472 B1 10/2004 Hickman
6,811,520 B2 11/2004 Wu
6,821,230 B2 11/2004 Dalebout et al.
6,830,540 B2 12/2004 Watterson
6,837,830 B2 1/2005 Eldridge
6,857,993 B2 2/2005 Yeh
6,863,641 B1 3/2005 Brown et al.
6,866,613 B1 3/2005 Brown et al.
6,875,160 B2 4/2005 Watterson et al.
6,878,101 B2 4/2005 Colley
D507,311 S 7/2005 Butler et al.
6,918,858 B2 7/2005 Watterson et al.
6,921,351 B1 7/2005 Hickman et al.
6,958,032 B1 10/2005 Smith
D511,190 S 11/2005 Panatta
D512,113 S 11/2005 Carter
6,974,404 B1 12/2005 Watterson et al.
6,997,852 B2 2/2006 Watterson et al.
7,011,326 B1 3/2006 Schroeder et al.
7,025,713 B2 4/2006 Dalebout
D520,085 S 5/2006 Willardson et al.
7,044,897 B2 5/2006 Myers et al.
7,052,442 B2 5/2006 Watterson
7,060,006 B1 6/2006 Watterson et al.
7,060,008 B2 6/2006 Watterson et al.
7,070,539 B2 7/2006 Brown et al.
7,070,542 B2 7/2006 Reyes
7,097,588 B2 8/2006 Watterson
D527,776 S 9/2006 Willardson et al.
7,112,168 B2 9/2006 Dalebout et al.
7,125,369 B2 10/2006 Endelman
7,128,693 B2 10/2006 Brown et al.
7,132,939 B2 11/2006 Tyndall
7,153,240 B1 12/2006 Wu
7,166,062 B1 1/2007 Watterson et al.
7,166,064 B2 1/2007 Watterson et al.
7,169,087 B2 1/2007 Ercanbrack et al.
7,169,093 B2 1/2007 Simonson et al.
7,172,536 B2 2/2007 Liu
7,192,387 B2 3/2007 Mendel
7,192,388 B2 3/2007 Dalebout et al.
7,226,402 B1 6/2007 Joya
7,250,022 B2 7/2007 Dalebout
D552,193 S 10/2007 Husted et al.
7,282,016 B2 10/2007 Simonson
7,285,075 B2 10/2007 Cutler et al.
7,311,640 B2 12/2007 Baatz
7,344,481 B2 3/2008 Watterson et al.
7,364,538 B2 4/2008 Aucamp
7,377,882 B2 5/2008 Watterson
7,381,161 B2 6/2008 Ellis
7,425,188 B2 9/2008 Ercanbrack
7,429,236 B2 9/2008 Dalebout et al.
7,452,311 B2 11/2008 Barnes
7,455,622 B2 11/2008 Watterson et al.
7,470,219 B2 12/2008 Larson
7,482,050 B2 1/2009 Olson
D588,655 S 3/2009 Utykanski
7,510,509 B2 3/2009 Hickman
7,524,272 B2 4/2009 Burck et al.
7,537,546 B2 5/2009 Watterson et al.
7,537,549 B2 5/2009 Nelson et al.
7,537,552 B2 5/2009 Dalebout et al.
7,540,828 B2 6/2009 Watterson et al.
7,549,947 B2 6/2009 Watterson et al.
7,556,590 B2 7/2009 Watterson et al.
7,563,203 B2 7/2009 Dalebout et al.
7,575,536 B1 8/2009 Hickman
7,575,537 B2 8/2009 Ellis
7,578,771 B1 8/2009 Towley, III et al.
7,584,673 B2 9/2009 Shimizu
7,601,105 B1 10/2009 Gipson, III et al.
7,604,572 B2 10/2009 Stanford
7,604,573 B2 10/2009 Dalebout et al.
D604,373 S 11/2009 Dalebout et al.
7,618,350 B2 11/2009 Dalebout et al.
7,618,357 B2 11/2009 Dalebout
7,625,315 B2 12/2009 Hickman
7,625,321 B2 12/2009 Simonson et al.
7,628,730 B1 12/2009 Watterson et al.
7,628,737 B2 12/2009 Kowallis et al.
7,637,847 B1 12/2009 Hickman
7,641,597 B2 1/2010 Schmidt
7,645,212 B2 1/2010 Ashby et al.
7,645,213 B2 1/2010 Watterson
7,658,698 B2 2/2010 Pacheco et al.
7,674,205 B2 3/2010 Dalebout et al.
7,713,171 B1 5/2010 Hickman
7,713,172 B2 5/2010 Watterson et al.
7,713,180 B2 5/2010 Wickens
7,717,828 B2 5/2010 Simonson et al.
7,736,279 B2 6/2010 Dalebout et al.
7,740,563 B2 6/2010 Dalebout et al.
7,749,144 B2 7/2010 Hammer
7,766,797 B2 8/2010 Dalebout
7,771,320 B2 8/2010 Riley
7,771,329 B2 8/2010 Dalebout et al.
7,775,940 B2 8/2010 Dalebout et al.
7,789,800 B1 9/2010 Watterson et al.
7,798,946 B2 9/2010 Dalebout et al.
7,806,589 B2 10/2010 Tashman
7,815,548 B2 10/2010 Barre
7,815,550 B2 10/2010 Watterson et al.
7,857,731 B2 12/2010 Hickman et al.
7,862,475 B2 1/2011 Watterson
7,862,478 B2 1/2011 Watterson et al.
7,862,483 B2 1/2011 Hendrickson et al.
7,862,489 B2 1/2011 Savsek
7,887,470 B2 2/2011 Chen
D633,581 S 3/2011 Thulin
D635,207 S 3/2011 Dalebout et al.
7,901,324 B2 3/2011 Kodama
7,901,330 B2 3/2011 Dalebout et al.
7,909,740 B2 3/2011 Dalebout et al.
7,942,793 B2 5/2011 Mills et al.
7,980,996 B2 7/2011 Hickman
7,981,000 B2 7/2011 Watterson et al.
7,985,164 B2 7/2011 Ashby
8,007,409 B2 8/2011 Ellis
8,029,415 B2 10/2011 Ashby et al.
8,029,425 B2 10/2011 Bronston et al.
8,033,960 B1 10/2011 Dalebout et al.
D650,451 S 12/2011 Olson et al.
8,070,657 B2 12/2011 Loach
8,075,453 B1 12/2011 Wilkinson
D652,877 S 1/2012 Dalebout et al.
8,096,926 B1 1/2012 Batca
8,152,702 B2 4/2012 Pacheco
8,157,708 B2 4/2012 Daly

(56) References Cited

U.S. PATENT DOCUMENTS

D659,775 S 5/2012 Olson et al.
D659,777 S 5/2012 Watterson et al.
D660,383 S 5/2012 Watterson et al.
D664,613 S 7/2012 Dalebout et al.
8,251,874 B2 8/2012 Ashby et al.
8,257,232 B2 9/2012 Albert
8,298,123 B2 10/2012 Hickman
8,298,125 B2 10/2012 Colledge et al.
D671,177 S 11/2012 Sip
D671,178 S 11/2012 Sip
8,308,618 B2 11/2012 Bayerlein
D673,626 S 1/2013 Olson et al.
8,398,529 B2 3/2013 Ellis et al.
8,500,607 B2 8/2013 Vittone et al.
8,517,899 B2 8/2013 Zhou
8,550,964 B2 10/2013 Ish, III et al.
8,608,624 B2 12/2013 Shabodyash
8,690,735 B2 4/2014 Watterson et al.
D707,763 S 6/2014 Cutler
8,740,753 B2 6/2014 Olson et al.
8,747,285 B2 6/2014 Hof
8,758,201 B2 6/2014 Ashby et al.
8,764,609 B1 7/2014 Elahmadie
8,771,153 B2 7/2014 Dalebout et al.
8,784,270 B2 7/2014 Watterson
8,784,275 B2 7/2014 Mikan
8,784,278 B2 7/2014 Flake
8,808,148 B2 8/2014 Watterson
8,808,152 B1 8/2014 Midgett
8,814,762 B2 8/2014 Butler
D712,493 S 9/2014 Ercanbrack et al.
8,840,075 B2 9/2014 Olson
8,845,493 B2 9/2014 Watterson et al.
8,870,726 B2 10/2014 Watterson et al.
8,876,668 B2 11/2014 Hendrickson et al.
8,894,549 B2 11/2014 Colledge
8,894,555 B2 11/2014 Olson
8,911,330 B2 12/2014 Watterson et al.
8,920,288 B2 12/2014 Dalebout
8,920,347 B2 12/2014 Bayerlein
8,979,709 B2 3/2015 Toback
8,986,165 B2 3/2015 Ashby
8,992,364 B2 3/2015 Law et al.
8,992,387 B2 3/2015 Watterson et al.
D726,476 S 4/2015 Ercanbrack
9,011,291 B2 4/2015 Birrell
9,028,368 B2 5/2015 Ashby et al.
9,028,370 B2 5/2015 Watterson
9,039,578 B2 5/2015 Dalebout
D731,011 S 6/2015 Buchanan
9,044,635 B2 6/2015 Lull
9,072,930 B2 7/2015 Ashby et al.
9,119,983 B2 9/2015 Rhea
9,119,988 B2 9/2015 Murray
9,123,317 B2 9/2015 Watterson et al.
9,126,071 B2 9/2015 Smith
9,126,072 B2 9/2015 Watterson
9,138,615 B2 9/2015 Olson et al.
9,142,139 B2 9/2015 Watterson et al.
9,144,703 B2 9/2015 Dalebout et al.
9,149,683 B2 9/2015 Smith
9,170,223 B2 10/2015 Hyun
9,186,535 B2 11/2015 Ercanbrack
9,186,549 B2 11/2015 Watterson et al.
9,186,552 B1 11/2015 Deal
D746,388 S 12/2015 Hockridge
9,211,433 B2 12/2015 Hall
9,227,101 B2 1/2016 Maguire
9,233,272 B2 1/2016 Villani
9,254,409 B2 2/2016 Dalebout et al.
9,254,416 B2 2/2016 Ashby
9,278,248 B2 3/2016 Tyger
9,278,249 B2 3/2016 Watterson
9,278,250 B2 3/2016 Buchanan
9,289,648 B2 3/2016 Watterson
9,292,935 B2 3/2016 Koduri et al.
9,308,417 B2 4/2016 Grundy
9,339,683 B2 5/2016 Dilli
9,339,691 B2 5/2016 Brammer
9,352,185 B2 5/2016 Hendrickson et al.
9,352,186 B2 5/2016 Watterson
9,364,714 B2 6/2016 Koduri et al.
9,375,605 B2 6/2016 Tyger
9,378,336 B2 6/2016 Ohnemus
9,381,394 B2 7/2016 Mortensen et al.
9,387,387 B2 7/2016 Dalebout
9,393,453 B2 7/2016 Watterson
9,403,047 B2 8/2016 Olson et al.
9,403,051 B2 8/2016 Cutler
9,415,257 B2 8/2016 Habing
9,421,416 B2 8/2016 Mortensen et al.
9,457,219 B2 10/2016 Smith
9,457,220 B2 10/2016 Olson
9,457,222 B2 10/2016 Dalebout
9,460,632 B2 10/2016 Watterson
9,463,356 B2 10/2016 Rhea
9,468,793 B2 10/2016 Salmon
9,468,794 B2 10/2016 Barton
9,468,798 B2 10/2016 Dalebout
9,480,874 B2 11/2016 Cutler
9,492,704 B2 11/2016 Mortensen et al.
9,498,668 B2 11/2016 Smith
9,511,259 B2 12/2016 Mountain
9,517,378 B2 12/2016 Ashby et al.
9,521,901 B2 12/2016 Dalebout
9,533,187 B2 1/2017 Dalebout
9,539,458 B1 1/2017 Ross
9,539,461 B2 1/2017 Ercanbrack
9,550,091 B2 1/2017 Emerson
9,579,544 B2 2/2017 Watterson
9,586,086 B2 3/2017 Dalebout et al.
9,586,090 B2 3/2017 Watterson et al.
9,604,099 B2 3/2017 Taylor
9,616,276 B2 4/2017 Dalebout et al.
9,616,278 B2 4/2017 Olson
9,623,281 B2 4/2017 Hendrickson
9,636,567 B2 5/2017 Brammer et al.
9,662,529 B2 5/2017 Miller et al.
9,675,839 B2 6/2017 Dalebout
9,682,307 B2 6/2017 Dalebout
9,694,234 B2 7/2017 Dalebout et al.
9,694,242 B2 7/2017 Ashby
9,700,751 B2 7/2017 Verdi
9,737,755 B2 8/2017 Dalebout
9,750,454 B2 9/2017 Walke
9,757,605 B2 9/2017 Olson et al.
9,764,186 B2 9/2017 Dalebout
9,767,785 B2 9/2017 Ashby
9,776,032 B2 10/2017 Moran
9,795,822 B2 10/2017 Smith et al.
9,795,855 B2 10/2017 Jafarifesharaki
9,808,672 B2 11/2017 Dalebout
9,849,326 B2 12/2017 Smith
D807,445 S 1/2018 Gettle
9,878,200 B2 1/2018 Edmondson
9,878,210 B2 1/2018 Watterson
9,889,334 B2 2/2018 Ashby et al.
9,889,339 B2 2/2018 Douglass
9,937,376 B2 4/2018 McInelly et al.
9,937,377 B2 4/2018 McInelly et al.
9,937,378 B2 4/2018 Dalebout et al.
9,937,379 B2 4/2018 Mortensen
9,943,719 B2 4/2018 Smith et al.
9,943,722 B2 4/2018 Dalebout
9,948,037 B2 4/2018 Ashby
9,968,816 B2 5/2018 Olson et al.
9,968,821 B2 5/2018 Finlayson et al.
9,968,823 B2 5/2018 Cutler
9,980,465 B2 5/2018 Hayashi
10,010,755 B2 7/2018 Watterson
10,010,756 B2 7/2018 Watterson
10,029,145 B2 7/2018 Douglass
D826,350 S 8/2018 Hochstrasser
10,046,196 B2 8/2018 Ercanbrack

(56) References Cited

U.S. PATENT DOCUMENTS

D827,733 S 9/2018 Hochstrasser
10,065,064 B2 9/2018 Smith et al.
10,071,285 B2 9/2018 Smith et al.
10,085,586 B2 10/2018 Smith et al.
10,086,254 B2 10/2018 Watterson
10,118,064 B1 11/2018 Cox
10,136,842 B2 11/2018 Ashby
10,186,161 B2 1/2019 Watterson
10,188,890 B2 1/2019 Olson et al.
10,207,143 B2 2/2019 Dalebout
10,207,145 B2 2/2019 Tyger
10,207,147 B2 2/2019 Ercanbrack
10,207,148 B2 2/2019 Powell
10,212,994 B2 2/2019 Watterson
10,220,259 B2 3/2019 Brammer
10,226,396 B2 3/2019 Ashby
10,226,664 B2 3/2019 Dalebout
10,252,109 B2 4/2019 Watterson
10,258,828 B2 4/2019 Dalebout
10,272,317 B2 4/2019 Watterson
10,279,212 B2 5/2019 Dalebout et al.
10,293,211 B2 5/2019 Watterson et al.
D852,292 S 6/2019 Cutler
10,343,017 B2 7/2019 Jackson
10,376,736 B2 8/2019 Powell et al.
10,388,183 B2 8/2019 Watterson
10,391,361 B2 8/2019 Watterson
D864,320 S 10/2019 Weston
D864,321 S 10/2019 Weston
10,426,989 B2 10/2019 Dalebout
10,433,612 B2 10/2019 Ashby
10,441,840 B2 10/2019 Dalebout et al.
10,449,416 B2 10/2019 Dalebout
D868,090 S 12/2019 Cutler et al.
D868,909 S 12/2019 Cutler
10,492,519 B2 12/2019 Capell
10,493,349 B2 12/2019 Watterson
10,500,473 B2 12/2019 Watterson
10,543,395 B2 1/2020 Powell et al.
10,561,877 B2 2/2020 Workman
10,561,893 B2 2/2020 Chatterton
10,561,894 B2 2/2020 Dalebout
10,569,121 B2 2/2020 Watterson
10,569,123 B2 2/2020 Hochstrasser
10,668,320 B2 6/2020 Watterson
10,758,767 B2 9/2020 Olson et al.
2001/0016542 A1 8/2001 Yoshimura
2002/0013200 A1 1/2002 Sechrest
2002/0016235 A1 2/2002 Ashby et al.
2002/0025888 A1 2/2002 Germanton
2002/0077221 A1 6/2002 Dalebout et al.
2002/0086779 A1 7/2002 Wilkinson
2002/0128127 A1 9/2002 Chen
2002/0159253 A1 10/2002 Dalebout et al.
2003/0032528 A1 2/2003 Wu et al.
2003/0032531 A1 2/2003 Simonson
2003/0032535 A1 2/2003 Wang et al.
2003/0045406 A1 3/2003 Stone
2003/0171189 A1 9/2003 Kaufman
2003/0171192 A1 9/2003 Wu et al.
2003/0176261 A1 9/2003 Simonson et al.
2003/0181293 A1 9/2003 Baatz
2004/0043873 A1 3/2004 Wilkinson et al.
2004/0091307 A1 5/2004 James
2004/0102292 A1 5/2004 Pyles et al.
2004/0171464 A1 9/2004 Ashby et al.
2004/0171465 A1 9/2004 Hald et al.
2004/0176227 A1 9/2004 Endelman
2004/0204294 A2 10/2004 Wilkinson
2005/0049117 A1 3/2005 Rodgers
2005/0049123 A1 3/2005 Dalebout et al.
2005/0077805 A1 4/2005 Dalebout et al.
2005/0107229 A1 5/2005 Wickens
2005/0130814 A1 6/2005 Nitta et al.
2005/0148445 A1 7/2005 Carle
2005/0164837 A1 7/2005 Anderson et al.
2005/0164839 A1 7/2005 Watterson et al.
2005/0272577 A1 12/2005 Olson et al.
2005/0277520 A1 12/2005 Van Waes
2006/0035755 A1 2/2006 Dalebout et al.
2006/0035768 A1 2/2006 Kowalllis et al.
2006/0135322 A1 6/2006 Rocker
2006/0148622 A1 7/2006 Chen
2006/0217237 A1 9/2006 Rhodes
2006/0240955 A1 10/2006 Pu
2006/0240959 A1 10/2006 Huang
2006/0252613 A1 11/2006 Barnes et al.
2007/0066448 A1 3/2007 Pan
2007/0117683 A1 5/2007 Ercanbrack et al.
2007/0123395 A1 5/2007 Ellis
2007/0173392 A1 7/2007 Stanford
2007/0197346 A1 8/2007 Seliber
2007/0197353 A1 8/2007 Hundley
2007/0232463 A1 10/2007 Wu
2007/0254778 A1 11/2007 Ashby
2007/0287601 A1 12/2007 Burck et al.
2008/0051256 A1 2/2008 Ashby et al.
2008/0119337 A1 5/2008 Wilkins et al.
2008/0242511 A1 10/2008 Munoz
2008/0242520 A1 10/2008 Hubbard
2008/0300110 A1 12/2008 Smith et al.
2009/0036276 A1 2/2009 Loach
2009/0105052 A1 4/2009 Dalebout et al.
2010/0197462 A1 8/2010 Piane, Jr.
2010/0242246 A1 9/2010 Dalebout et al.
2010/0255965 A1 10/2010 Chen
2010/0317488 A1 12/2010 Cartaya
2011/0009249 A1 1/2011 Campanaro et al.
2011/0082013 A1 4/2011 Bastian
2011/0131005 A1 6/2011 Ueshima
2011/0281691 A1 11/2011 Ellis
2012/0065034 A1 3/2012 Loach
2012/0088638 A1 4/2012 Lull
2012/0237911 A1 9/2012 Watterson
2012/0277068 A1 11/2012 Zhou et al.
2012/0295774 A1 11/2012 Dalebout et al.
2013/0014321 A1 1/2013 Sullivan
2013/0065732 A1 3/2013 Hopp
2013/0090216 A1 4/2013 Jackson
2013/0109543 A1 5/2013 Reyes
2013/0123073 A1 5/2013 Olson et al.
2013/0123083 A1 5/2013 Sip
2013/0165195 A1 6/2013 Watterson
2013/0172152 A1 7/2013 Watterson
2013/0172153 A1 7/2013 Watterson
2013/0178334 A1 7/2013 Brammer
2013/0178768 A1 7/2013 Dalebout
2013/0190136 A1 7/2013 Watterson
2013/0196298 A1 8/2013 Watterson
2013/0196821 A1 8/2013 Watterson et al.
2013/0196822 A1 8/2013 Watterson et al.
2013/0218585 A1 8/2013 Watterson
2013/0244836 A1 9/2013 Maughan
2013/0267383 A1 10/2013 Watterson
2013/0268101 A1 10/2013 Brammer
2013/0274067 A1 10/2013 Watterson et al.
2013/0281241 A1 10/2013 Watterson
2013/0303334 A1 11/2013 Adhami et al.
2013/0337981 A1 12/2013 Habing
2014/0024499 A1 1/2014 Watterson
2014/0073970 A1 3/2014 Ashby
2014/0121071 A1 5/2014 Strom et al.
2014/0135173 A1 5/2014 Watterson
2014/0187389 A1 7/2014 Berg
2014/0235409 A1 8/2014 Salmon et al.
2014/0274574 A1 9/2014 Shorten et al.
2014/0274579 A1 9/2014 Olson
2014/0287884 A1 9/2014 Buchanan
2014/0309085 A1 10/2014 Watterson et al.
2014/0357457 A1 12/2014 Boekema
2014/0371035 A1 12/2014 Mortensen et al.
2015/0038300 A1 2/2015 Forhan et al.
2015/0182779 A1 7/2015 Dalebout
2015/0182781 A1 7/2015 Watterson

(56) References Cited

U.S. PATENT DOCUMENTS

| | | | |
|---|---|---|---|
| 2015/0238817 | A1 | 8/2015 | Watterson |
| 2015/0250418 | A1 | 9/2015 | Ashby |
| 2015/0251055 | A1 | 9/2015 | Ashby |
| 2015/0253210 | A1 | 9/2015 | Ashby et al. |
| 2015/0253735 | A1 | 9/2015 | Watterson |
| 2015/0253736 | A1 | 9/2015 | Watterson |
| 2015/0258560 | A1 | 9/2015 | Ashby |
| 2015/0306440 | A1 | 10/2015 | Bucher et al. |
| 2015/0352396 | A1 | 12/2015 | Dalebout |
| 2015/0367161 | A1 | 12/2015 | Wiegardt |
| 2016/0058335 | A1 | 3/2016 | Ashby |
| 2016/0063615 | A1 | 3/2016 | Watterson |
| 2016/0092909 | A1 | 3/2016 | Watterson |
| 2016/0101311 | A1 | 4/2016 | Workman |
| 2016/0107065 | A1 | 4/2016 | Brammer |
| 2016/0121074 | A1 | 5/2016 | Ashby |
| 2016/0148535 | A1 | 5/2016 | Ashby |
| 2016/0148536 | A1 | 5/2016 | Ashby |
| 2016/0158595 | A1 | 6/2016 | Dalebout |
| 2016/0206248 | A1 | 7/2016 | Sartor et al. |
| 2016/0206922 | A1 | 7/2016 | Dalebout et al. |
| 2016/0250519 | A1 | 9/2016 | Watterson |
| 2016/0253918 | A1 | 9/2016 | Watterson |
| 2016/0303453 | A1 | 10/2016 | Kim |
| 2016/0339298 | A1 | 11/2016 | Kats |
| 2016/0346595 | A1 | 12/2016 | Dalebout et al. |
| 2016/0346617 | A1 | 12/2016 | Srugo et al. |
| 2017/0036053 | A1 | 2/2017 | Smith et al. |
| 2017/0056711 | A1 | 3/2017 | Dalebout et al. |
| 2017/0056715 | A1 | 3/2017 | Dalebout et al. |
| 2017/0056726 | A1 | 3/2017 | Dalebout et al. |
| 2017/0124912 | A1 | 5/2017 | Ashby et al. |
| 2017/0193578 | A1 | 7/2017 | Watterson |
| 2017/0266481 | A1 | 9/2017 | Dalebout |
| 2017/0266483 | A1 | 9/2017 | Dalebout et al. |
| 2017/0266489 | A1 | 9/2017 | Douglass et al. |
| 2017/0266532 | A1 | 9/2017 | Watterson |
| 2017/0266533 | A1 | 9/2017 | Dalebout |
| 2017/0270820 | A1 | 9/2017 | Ashby |
| 2017/0319941 | A1 | 11/2017 | Smith et al. |
| 2018/0001135 | A1 | 1/2018 | Powell |
| 2018/0036585 | A1 | 2/2018 | Powell |
| 2018/0084817 | A1 | 3/2018 | Capell et al. |
| 2018/0085630 | A1 | 3/2018 | Capell et al. |
| 2018/0089396 | A1 | 3/2018 | Capell et al. |
| 2018/0099116 | A1 | 4/2018 | Ashby |
| 2018/0099179 | A1 | 4/2018 | Chatterton et al. |
| 2018/0099180 | A1 | 4/2018 | Wilkinson |
| 2018/0099205 | A1 | 4/2018 | Watterson |
| 2018/0111034 | A1 | 4/2018 | Watterson |
| 2018/0117383 | A1 | 5/2018 | Workman |
| 2018/0117385 | A1 | 5/2018 | Watterson et al. |
| 2018/0117393 | A1 | 5/2018 | Ercanbrack |
| 2018/0154205 | A1 | 6/2018 | Watterson |
| 2018/0154207 | A1 | 6/2018 | Hochstrasser |
| 2018/0154208 | A1 | 6/2018 | Powell et al. |
| 2018/0154209 | A1 | 6/2018 | Watterson |
| 2018/0200566 | A1 | 7/2018 | Weston |
| 2019/0058370 | A1 | 2/2019 | Tinney |
| 2019/0080624 | A1 | 3/2019 | Watterson |
| 2019/0151698 | A1 | 5/2019 | Olson et al. |
| 2019/0168072 | A1 | 6/2019 | Brammer |
| 2019/0178313 | A1 | 6/2019 | Wrobel |
| 2019/0192898 | A1 | 6/2019 | Dalebout |
| 2019/0192952 | A1 | 6/2019 | Powell |
| 2019/0209893 | A1 | 7/2019 | Watterson |
| 2019/0223612 | A1 | 7/2019 | Watterson |
| 2019/0232112 | A1 | 8/2019 | Dalebout |
| 2019/0269958 | A1 | 9/2019 | Dalebout et al. |
| 2019/0269971 | A1 | 9/2019 | Capell et al. |
| 2019/0275366 | A1 | 9/2019 | Powell |
| 2019/0282852 | A1 | 9/2019 | Dalebout |
| 2019/0328079 | A1 | 10/2019 | Ashby et al. |
| 2019/0329091 | A1 | 10/2019 | Powell et al. |
| 2019/0376585 | A1 | 12/2019 | Buchanan |
| 2020/0009417 | A1 | 1/2020 | Dalebout |
| 2020/0016459 | A1 | 1/2020 | Smith |
| 2020/0254295 | A1 | 8/2020 | Watterson |
| 2020/0254309 | A1 | 8/2020 | Watterson |
| 2020/0338389 | A1 | 10/2020 | Dalebout et al. |
| 2020/0391069 | A1 | 12/2020 | Olson et al. |

FOREIGN PATENT DOCUMENTS

| | | | |
|---|---|---|---|
| CN | 101784308 | | 11/2001 |
| CN | 1658929 | | 8/2005 |
| CN | 1708333 | | 12/2005 |
| CN | 2841072 | Y | 11/2006 |
| CN | 201516258 | | 6/2010 |
| CN | 201410258 | Y | 2/2014 |
| CN | 103801048 | | 5/2014 |
| CN | 203989681 | | 12/2014 |
| CN | 10488413 | | 9/2015 |
| CN | 105848733 | | 8/2016 |
| CN | 104884133 | B | 2/2018 |
| CN | 106470739 | B | 6/2019 |
| CN | 110035801 | | 7/2019 |
| EP | 1188460 | | 3/2002 |
| EP | 2969058 | | 1/2016 |
| EP | 3086865 | A1 | 11/2016 |
| EP | 3086865 | A1 | 1/2020 |
| EP | 3086865 | | 2/2020 |
| EP | 3623020 | | 3/2020 |
| EP | 2969058 | | 5/2020 |
| JP | 2002-011114 | | 1/2002 |
| JP | 2013543749 | | 12/2013 |
| KR | 100829774 | | 5/2008 |
| SU | 1533710 | | 1/1990 |
| TW | I339127 | | 8/2008 |
| TW | M422981 | | 2/2012 |
| TW | M464203 | | 11/2013 |
| TW | M495871 | | 2/2015 |
| TW | M504568 | | 3/2015 |
| TW | 201821129 | A | 6/2018 |
| TW | 201821130 | A | 6/2018 |
| TW | 201601802 | A | 12/2018 |
| WO | 1989002217 | | 3/1989 |
| WO | 1997006859 | | 2/1997 |
| WO | 2000030717 | | 6/2000 |
| WO | 2002053234 | A1 | 7/2002 |
| WO | 2007015096 | A3 | 2/2007 |
| WO | 2009/000059 | | 12/2008 |
| WO | 2009/014330 | | 1/2009 |
| WO | 2009014330 | | 1/2009 |
| WO | 2014153158 | | 9/2014 |
| WO | 2015/100429 | | 7/2015 |
| WO | 2015191445 | | 12/2015 |
| WO | 2018106598 | | 6/2018 |
| WO | 2018106603 | | 6/2018 |

OTHER PUBLICATIONS

Exxentric, Movie Archives, obtained from The Wayback Machine for http://exxentric.com/movies/ accessed for Aug. 19, 2015.

International Search Report & Written Opinion for PCT Application No. PCT/US2014/072390, dated Mar. 27, 2015, 9 pages.

Supplemental European Search Report for European Application No. 14874303, dated May 10, 2017, 6 pages.

*Nautilus, Inc.* v. *ICON Health & Fitness, Inc.*, Civil Case No. IPR2017-01363, Petition for Inter Partes Review of U.S. Pat. No. 9,403,047, filed May 5, 2017; 76 pages (paper 2).

*Nautilus, Inc.* v. *ICON Health & Fitness, Inc.*, Civil Case No. IPR2017-01363, Olson, U.S. Pat. No. 9,403,047, 16 pages, (Petition EX. 1001).

*Nautilus, Inc.* v. *ICON Health & Fitness, Inc.*, Civil Case No. IPR2017-01363, Sleamaker, U.S. Pat. No. 5,354,251, 14 pages, (Petition EX. 1002).

*Nautilus, Inc.* v. *ICON Health & Fitness, Inc.*, Civil Case No. IPR2017-01363, Hanoun, U.S. Publication No. 2007-0232452, 28 pages, (Petition EX. 1003).

(56) References Cited

OTHER PUBLICATIONS

*Nautilus, Inc.* v. *ICON Health & Fitness, Inc.*, Civil Case No. IPR2017-01363, Six-Pak, Printed Publication TuffStuff Fitness Six-Pak Trainer Owner's Manual, 19 pages, (Petition EX 1004).
*Nautilus, Inc.* v. *ICON Health & Fitness, Inc.*, Civil Case No. IPR2017-01363, Ehrenfried, U.S. Pat. No. 5,738,611, 19 pages, (Petition EX. 1005).
*Nautilus, Inc.* v. *ICON Health & Fitness, Inc.*, Civil Case No. IPR2017-01363, Kleinman, International Publication No. WO2008/152627, 65 pages, (Petition EX. 1006).
*Nautilus, Inc.* v. *ICON Health & Fitness, Inc.*, Civil Case No. IPR2017-01363, Declaration of Lee Rawls, (Petition EX. 1007).
*Nautilus, Inc.* v. *ICON Health & Fitness, Inc.*, Civil Case No. IPR2017-01363, U.S. Pat. No. 9,403,047 File history, 130 pages, (Petition EX. 1008).
*Nautilus, Inc.* v. *ICON Health & Fitness, Inc.*, Civil Case No. IPR2017-01363, U.S. Appl. No. 61/920,834, 38 pages, (Petition EX. 1009).
*Nautilus, Inc.* v. *ICON Health & Fitness, Inc.*, Civil Case No. IPR2017-01363, Declaration of Christopher Butler, 26 pages, (Petition EX. 1010).
*Nautilus, Inc.* v. *ICON Health & Fitness, Inc.*, Civil Case No. IPR2017-01363, Petitioner's Power of Attorney, filed May 5, 2017, 2 pages (paper 2).
*Nautilus, Inc.* v. *ICON Health & Fitness, Inc.*, Civil Case No. IPR2017-01363, Mandatory Notice to Patent Owner, filed May 19, 2017, 4 pages (paper 3).
*Nautilus, Inc.* v. *ICON Health & Fitness, Inc.*, Civil Case No. IPR2017-01363, Power of Attorney, filed May 19, 2017, 3 pages (paper 4).
*Nautilus, Inc.* v. *ICON Health & Fitness, Inc.*, Civil Case No. IPR2017-01363, Notice of Accord Filing Date, filed Jun. 9, 2017, 5 pages (paper 5).
U.S. Appl. No. 61/786,007, filed Mar. 14, 2013, titled "Strength Training Apparatus with Flywheel and Related Methods", 28 pages.
U.S. Appl. No. 62/009,607, filed Jun. 9, 2014, titled "Cable System Incorporated into a Treadmill", 32 pages.
International Search Report & Written Opinion for PCT Application No. PCT/US2014/029353, dated Aug. 4, 2014, 9 pages.
Supplemental European Search Report for European Application No. 14768130, dated Oct. 11, 2016, 9 pages.
U.S. Appl. No. 15/472,954, filed Mar. 29, 2017, titled "Strength Training Apparatus with Flywheel and Related Methods", 22 pages.
U.S. Appl. No. 15/976,496, filed May 10, 2018, titled "Magnetic Resistance Mechanism in a Cable Machine", 36 pages.
*Nautilus, Inc.* v. *ICON Health & Fitness, Inc.*, Civil Case No. IPR2017-01407, Petition for Inter Partes Review of U.S. Pat. No. 9,616,276 (Claims 1-4, 7-10), filed May 5, 2017.
*Nautilus, Inc.* v. *ICON Health & Fitness, Inc.*, Civil Case No. IPR2017-01407, Dalebout et al., U.S. Pat. No. 9,616,276, (Petition EX. 1001).
*Nautilus, Inc.* v. *ICON Health & Fitness, Inc.*, Civil Case No. IPR2017-01407, Wu, U.S. Publication No. 20030171192, (Petition EX. 1002).
*Nautilus, Inc.* v. *ICON Health & Fitness, Inc.*, Civil Case No. IPR2017-01407, Webb, U.S. Publication No. 20030017918, (Petition EX. 1003).
*Nautilus, Inc.* v. *ICON Health & Fitness, Inc.*, Civil Case No. IPR2017-01407, Watson, U.S. Publication No. 20060234840, (Petition EX. 1004).
*Nautilus, Inc.* v. *ICON Health & Fitness, Inc.*, Civil Case No. IPR2017-01407, Jones, U.S. Pat. No. 4,798,378, (Petition EX. 1005).
*Nautilus, Inc.* v. *ICON Health & Fitness, Inc.*, Civil Case No. IPR2017-01407, Zhou et al., U.S. Pat. No. 8,517,899, (Petition EX. 1006).
*Nautilus, Inc.* v. *ICON Health & Fitness, Inc.*, Civil Case No. IPR2017-01407, Loach, U.S. Publication No. WO2007015096, (Petition EX. 1007).
*Nautilus, Inc.* v. *ICON Health & Fitness, Inc.*, Civil Case No. IPR2017-01407, Rawls Declaration, Part 1 & 2, (Petition EX. 1008).
*Nautilus, Inc.* v. *ICON Health & Fitness, Inc.*, Civil Case No. IPR2017-01407, U.S. Pat. No. 9,616,276 File History, (Petition EX. 1009).
*Nautilus, Inc.* v. *ICON Health & Fitness, Inc.*, Civil Case No. IPR2017-01407, U.S. Appl. No. 61/786,007 File History, (Petition EX. 1010).
*Nautilus, Inc.* v. *ICON Health & Fitness, Inc.*, Civil Case No. IPR2017-01407, Sawicky, U.S. Pat. No. 5,042,798, (Petition EX. 1011).
*Nautilus, Inc.* v. *ICON Health & Fitness, Inc.*, Civil Case No. IPR2017-01407, Petitioner's Power of Attorney, filed May 5, 2017.
*Nautilus, Inc.* v. *ICON Health & Fitness, Inc.*, Civil Case No. IPR2017-01407, Mandatory Notice to Patent Owner, filed May 19, 2017.
*Nautilus, Inc.* v. *ICON Health & Fitness, Inc.*, Civil Case No. IPR2017-01407, Power of Attorney, filed May 19, 2017.
*Nautilus, Inc.* v. *ICON Health & Fitness, Inc.*, Civil Case No. IPR2017-01407, Notice of Accord Filing Date, filed Jun. 6, 2017.
*Nautilus, Inc.* v. *ICON Health & Fitness, Inc.*, Civil Case No. IPR2017-01408, Petition for Inter Partes Review of U.S. Pat. No. 9,616,276 (Claims 1-20) filed May 5, 2017.
*Nautilus, Inc.* v. *ICON Health & Fitness, Inc.*, Civil Case No. IPR2017-01408, Dalebout et al., U.S. Pat. No. 9,616,276, (Petition EX. 1001).
*Nautilus, Inc.* v. *ICON Health & Fitness, Inc.*, Civil Case No. IPR2017-01408, Wu, U.S. Publication No. 20030171192, (Petition EX. 1002).
*Nautilus, Inc.* v. *ICON Health & Fitness, Inc.*, Civil Case No. IPR2017-01408, Webb, U.S. Publication No. 20030017918, (Petition EX. 1003).
*Nautilus, Inc.* v. *ICON Health & Fitness, Inc.*, Civil Case No. IPR2017-01408, Watson, U.S. Publication No. 20060234840, (Petition EX. 1004).
*Nautilus, Inc.* v. *ICON Health & Fitness, Inc.*, Civil Case No. IPR2017-01408, Jones, U.S. Pat. No. 4,798,378, (Petition EX. 1005).
*Nautilus, Inc.* v. *ICON Health & Fitness, Inc.*, Civil Case No. IPR2017-01408, Zhou et al., U.S. Pat. No. 8,517,899, (Petition EX. 1006).
*Nautilus, Inc.* v. *ICON Health & Fitness, Inc.*, Civil Case No. IPR2017-01408, Loach, U.S. Publication No. WO2007015096, (Petition EX. 1007).
*Nautilus, Inc.* v. *ICON Health & Fitness, Inc.*, Civil Case No. IPR2017-01408, Rawls Declaration, Part 1 & 2, (Petition EX. 1008).
*Nautilus, Inc.* v. *ICON Health & Fitness, Inc.*, Civil Case No. IPR2017-01408, U.S. Pat. No. 9,616,276 File History, (Petition EX. 1009).
*Nautilus, Inc.* v. *ICON Health & Fitness, Inc.*, Civil Case No. IPR2017-01408, U.S. Appl. No. 61/786,007 File History, (Petition EX. 1010).
*Nautilus, Inc.* v. *ICON Health & Fitness, Inc.*, Civil Case No. IPR2017-01408, Sawicky, U.S. Pat. No. 5,042,798, (Petition EX. 1011).
*Nautilus, Inc.* v. *ICON Health & Fitness, Inc.*, Civil Case No. IPR2017-01408, Petitioner's Power of Attorney, filed May 5, 2017.
*Nautilus, Inc.* v. *ICON Health & Fitness, Inc.*, Civil Case No. IPR2017-01408, Mandatory Notice to Patent Owner, filed May 19, 2017.
*Nautilus, Inc.* v. *ICON Health & Fitness, Inc.*, Civil Case No. IPR2017-01408, Power of Attorney, filed May 19, 2017.
*Nautilus, Inc.* v. *ICON Health & Fitness, Inc.*, Civil Case No. IPR2017-01408, Notice of Accord Filing Date, filed Jun. 6, 2017.
Chinese Office Action for Chinese Patent Application No. 201480003701.9 dated Apr. 6, 2016.
Chinese Search Report for Chinese Patent Application No. 2014800708329 dated Jun. 2, 2017.
*Nautilus, Inc.* v. *ICON Health & Fitness, Inc.*, Civil Case No. IPR2017-01363, Declaration of Tyson Hottinger in Support of Motion for Admission Pro Hac Vice, filed Feb. 1, 2018 (EX 2001).

(56) References Cited

OTHER PUBLICATIONS

*Nautilus, Inc.* v. *ICON Health & Fitness, Inc.*, Civil Case No. IPR2017-01363, Transcript of Deposition of R. Lee Rawls, filed Mar. 5, 2018 (Ex 2002).
*Nautilus, Inc.* v. *ICON Health & Fitness, Inc.*, Civil Case No. IPR2017-01363, Order Conduct of Proceedings, filed May 7, 2018 (Paper 20).
*Nautilus, Inc.* v. *ICON Health & Fitness, Inc.*, Civil Case No. IPR2017-01407, Decision Institution of Inter Partes Review, filed Dec. 4, 2017 (Paper 6).
*Nautilus, Inc.* v. *ICON Health & Fitness, Inc.*, Civil Case No. IPR2017-01407, Scheduling Order, filed Dec. 4, 2017 (Paper 7).
*Nautilus, Inc.* v. *ICON Health & Fitness, Inc.*, Civil Case No. IPR2017-01407, Order, filed Jan. 19, 2018 (Paper 8).
*Nautilus, Inc.* v. *ICON Health & Fitness, Inc.*, Civil Case No. IPR2017-01407, Patent Owner's Notice of Deposition of R. Lee Rawls, filed Jan. 19, 2018 (Paper 9).
*Nautilus, Inc.* v. *ICON Health & Fitness, Inc.*, Civil Case No. IPR2017-01407, Unopposed Motion for Pro Hac Vice Admission of Tyson Hottinger, filed Feb. 1, 2018 (Paper 10).
*Nautilus, Inc.* v. *ICON Health & Fitness, Inc.*, Civil Case No. IPR2017-01407, Patent Owner's Current Exhibit List, filed Feb. 1, 2018 (Paper 11).
*Nautilus, Inc.* v. *ICON Health & Fitness, Inc.*, Civil Case No. IPR2017-01407, Patent Owner's Updated Notice of Deposition of R. Lee Rawls, filed Feb. 1, 2018 (Paper 12).
*Nautilus, Inc.* v. *ICON Health & Fitness, Inc.*, Civil Case No. IPR2017-01407, Order Granting Motion of Pro Hac Vice Admission of Mr. Hottinger, filed Feb. 12, 2018 (Paper 13).
*Nautilus, Inc.* v. *ICON Health & Fitness, Inc.*, Civil Case No. IPR2017-01407, Petitioner's Updated Mandatory Notices, filed Feb. 20, 2018 (Paper 14).
*Nautilus, Inc.* v. *ICON Health & Fitness, Inc.*, Civil Case No. IPR2017-01407, Petitioner's Updated Power of Attorney, filed Feb. 20, 2018 (Paper 15).
*Nautilus, Inc.* v. *ICON Health & Fitness, Inc.*, Civil Case No. IPR2017-01407, Patent Owner's Motion to Amend, filed Mar. 5, 2018 (Paper 16).
*Nautilus, Inc.* v. *ICON Health & Fitness, Inc.*, Civil Case No. IPR2017-01407, Current Exhibit List of Patent Owner, filed Mar. 5, 2018 (Paper 17).
*Nautilus, Inc.* v. *ICON Health & Fitness, Inc.*, Civil Case No. IPR2017-01407, Order Conduct of Proceedings 37 C.F.R. Sec 42.5, filed Apr. 27, 2018 (Paper 18).
*Nautilus, Inc.* v. *ICON Health & Fitness, Inc.*, Civil Case No. IPR2017-01407, Order Conduct of Proceedings 37 C.F.R. Sec 42.5, filed May 7, 2018 (Paper 19).
*Nautilus, Inc.* v. *ICON Health & Fitness, Inc.*, Civil Case No. IPR2017-01407, Declaration of Tyson Hottinger in Support of Motion for Admission Pro Hac Vice, (Patent Owner EX. 2001).
*Nautilus, Inc.* v. *ICON Health & Fitness, Inc.*, Civil Case No. IPR2017-01407, Claim Listing of Proposed Substitute Claims for Patent Owner Motion to Amend, (Patent Owner EX. 2002).
*Nautilus, Inc.* v. *ICON Health & Fitness, Inc.*, Civil Case No. IPR2017-01407, Specification of U.S. Pat. No. 9,616,276, (Patent Owner EX. 2003).
*Nautilus, Inc.* v. *ICON Health & Fitness, Inc.*, Civil Case No. IPR2017-01407, Drawings of U.S. Pat. No. 9,616,276, (Patent Owner EX. 2004).
*Nautilus, Inc.* v. *ICON Health & Fitness, Inc.*, Civil Case No. IPR2017-01407, Specification of U.S. Pat. No. 9,254,409 (Patent Owner EX. 2005).
*Nautilus, Inc.* v. *ICON Health & Fitness, Inc.*, Civil Case No. IPR2017-01407, Drawings of U.S. Pat. No. 9,254,409 (Patent Owner EX. 2006).
*Nautilus, Inc.* v. *ICON Health & Fitness, Inc.*, Civil Case No. IPR2017-01407, Provisional Patent Specification of U.S. Appl. No. 61/786,007, (Patent Owner EX. 2007).
*Nautilus, Inc.* v. *ICON Health & Fitness, Inc.*, Civil Case No. IPR2017-01407, Provisional Patent Drawings of U.S. Appl. No. 61/786,007, (Patent Owner EX. 2008).
*Nautilus, Inc.* v. *ICON Health & Fitness, Inc.*, Civil Case No. IPR2017-01407, Specification of U.S. Appl. No. 13/754,361 (Patent Owner EX. 2009).
*Nautilus, Inc.* v. *ICON Health & Fitness, Inc.*, Civil Case No. IPR2017-01407, Drawings of U.S. Appl. No. 13/754,361 (Patent Owner EX. 2010).
*Nautilus, Inc.* v. *ICON Health & Fitness, Inc.*, Civil Case No. IPR2017-01407, Webster Dictionary p. 2211 (Merriam-Webster, Inc. 1961, 2002) (EX. 3001).
*Nautilus, Inc.* v. *ICON Health & Fitness, Inc.*, Civil Case No. IPR2017-01408, Patent Owner Preliminary Response to Petition, filed Sep. 5, 2017 (Paper 6).
*Nautilus, Inc.* v. *ICON Health & Fitness, Inc.*, Civil Case No. IPR2017-01408, Decision Institution of Inter Partes Review, filed Dec. 4, 2017 (Paper 7).
*Nautilus, Inc.* v. *ICON Health & Fitness, Inc.*, Civil Case No. IPR2017-01408, Scheduling Order, filed Dec. 4, 2017 (Paper 8).
*Nautilus, Inc.* v. *ICON Health & Fitness, Inc.*, Civil Case No. IPR2017-01408, Order Conduct of Proceeding, filed Jan. 19, 2018 (Paper 9).
*Nautilus, Inc.* v. *ICON Health & Fitness, Inc.*, Civil Case No. IPR2017-01408, Patent Owner's Notice of Deposition of R. Lee Rawls, filed Jan. 19, 2018 (Paper 10).
*Nautilus, Inc.* v. *ICON Health & Fitness, Inc.*, Civil Case No. IPR2017-01408, Unopposed Motion for Pro Hac Vice Admission of Tyson Hottinger, filed Feb. 1, 2018 (Paper 11).
*Nautilus, Inc.* v. *ICON Health & Fitness, Inc.*, Civil Case No. IPR2017-01408, Current Exhibit List for Patent Owner, filed Feb. 1, 2018 (Paper 12).
*Nautilus, Inc.* v. *ICON Health & Fitness, Inc.*, Civil Case No. IPR2017-01408, Patent Owner's Updated Notice of Deposition of R. Lee Rawls, Feb. 1, 2018 (Paper 13).
*Nautilus, Inc.* v. *ICON Health & Fitness, Inc.*, Civil Case No. IPR2017-01408, Order Granting Motion for Pro Hac Vice Admission, filed Feb. 12, 2018 (Paper 14).
*Nautilus, Inc.* v. *ICON Health & Fitness, Inc.*, Civil Case No. IPR2017-01408, Petitioner's Updated Mandatory Notices, filed Feb. 20, 2018 (Paper 15).
*Nautilus, Inc.* v. *ICON Health & Fitness, Inc.*, Civil Case No. IPR2017-01408, Petitioner's Updated Power of Attorney, filed Feb. 20, 2018 (Paper 16).
*Nautilus, Inc.* v. *ICON Health & Fitness, Inc.*, Civil Case No. IPR2017-01408, Patent Owners Motion to Amend, filed Mar. 5, 2018 (Paper 17).
*Nautilus, Inc.* v. *ICON Health & Fitness, Inc.*, Civil Case No. IPR2017-01408, Current Exhibit List of Patent Owner, filed Mar. 5, 2018 (Paper 18).
*Nautilus, Inc.* v. *ICON Health & Fitness, Inc.*, Civil Case No. IPR2017-01408, Order Conduct of Proceedings, filed Apr. 27, 2018 (Paper 19).
*Nautilus, Inc.* v. *ICON Health & Fitness, Inc.*, Civil Case No. IPR2017-01408, Order Conduct of Proceedings, filed May 7, 2018 (Paper 20).
*Nautilus, Inc.* v. *ICON Health & Fitness, Inc.*, Civil Case No. IPR2017-01408, Declaration of Tyson Hottinger in Support of Motion for Admission Pro Hac Vice, (Patent Owner EX. 2001).
*Nautilus, Inc.* v. *ICON Health & Fitness, Inc.*, Civil Case No. IPR2017-01408, Claim Listing of Proposed Substitute Claims for Patent Owner Motion to Amend, (Patent Owner EX. 2002).
*Nautilus, Inc.* v. *ICON Health & Fitness, Inc.*, Civil Case No. IPR2017-01408, Specification of U.S. Appl. No. 15/019,088, (Patent Owner EX. 2003).
*Nautilus, Inc.* v. *ICON Health & Fitness, Inc.*, Civil Case No. IPR2017-01408, Drawings of U.S. Appl. No. 15/019,088, (Patent Owner EX. 2004).
*Nautilus, Inc.* v. *ICON Health & Fitness, Inc.*, Civil Case No. IPR2017-01408, Specification of U.S. Appl. No. 14/213,793, (Patent Owner EX. 2005).

(56) References Cited

OTHER PUBLICATIONS

*Nautilus, Inc.* v. *ICON Health & Fitness, Inc.*, Civil Case No. IPR2017-01408, Drawings of U.S. Appl. No. 14/213,793, (Patent Owner EX. 2006).
*Nautilus, Inc.* v. *ICON Health & Fitness, Inc.*, Civil Case No. IPR2017-01408, Specification of U.S. Appl. No. 61/786,007, (Patent Owner EX. 2007).
*Nautilus, Inc.* v. *ICON Health & Fitness, Inc.*, Civil Case No. IPR2017-01408, Drawings of U.S. Appl. No. 61/786,007, (Patent Owner EX. 2008).
*Nautilus, Inc.* v. *ICON Health & Fitness, Inc.*, Civil Case No. IPR2017-01408, Specification of U.S. Appl. No. 13/754,361, (Patent Owner EX. 2009).
*Nautilus, Inc.* v. *ICON Health & Fitness, Inc.*, Civil Case No. IPR2017-01408, Drawings of U.S. Appl. No. 13/754,361, (Patent Owner EX. 2010).
*Nautilus, Inc.* v. *ICON Health & Fitness, Inc.*, Civil Case No. IPR2017-01408, Webster Dictionary p. 2211 (Merriam-Webster, Inc. 1961, 2002) (EX. 3001).
*Nautilus, Inc.* v. *ICON Health & Fitness, Inc.*, Civil Case No. IPR2017-01363, Petitioner's Reply in Support of Petition for Inter Partes Review; filed Jun. 4, 2018; 18 pages (paper 21).
*Nautilus, Inc.* v. *ICON Health & Fitness, Inc.*, Civil Case No. IPR2017-01363, Petitioner's Motion for Pro Hac Vice Admission, filed Jun. 6, 2018; 5 pages (paper 22).
*Nautilus, Inc.* v. *ICON Health & Fitness, Inc.*, Civil Case No. IPR2017-01363; Affidavit of Lane M. Polozola in support of Petitioner's Motion of Pro Hac Vice Admission Under 37 C.F.R. 42.10(c), filed Jun. 6, 2018, 4 pages (exhibit 1011).
*Nautilus, Inc.* v. *ICON Health & Fitness, Inc.*, Civil Case No. IPR2017-01363, Order granting Motion for Pro Hac Vice Admission—37 C.F.R. 42.10(c), filed Jun. 14, 2018; 4 pages (paper 23).
*Nautilus, Inc.* v. *ICON Health & Fitness, Inc.*, Civil Case No. IPR2017-01363, Petitioner's Updated Mandatory Notices, filed Jun. 20, 2018; 4 pages (paper 24).
*Nautilus, Inc.* v. *ICON Health & Fitness, Inc.*, Civil Case No. IPR2017-01363, Petitioner's Updated Power of Attorney, filed Jun. 20, 2018; 3 pages (paper 25).
*Nautilus, Inc.* v. *ICON Health & Fitness, Inc.*, Civil Case No. IPR2017-01363, Petitioner's Request for Oral Argument, filed Jul. 25, 2018; 4 pages; (paper 26).
*Nautilus, Inc.* v. *ICON Health & Fitness, Inc.*, Civil Case No. IPR2017-01363, Patent Owner's Request for Oral Argument, filed Jul. 25, 2018; 4 pages (paper 27).
*Nautilus, Inc.* v. *ICON Health & Fitness, Inc.*, Civil Case No. IPR2017-01363, Order 37 C.F.R. 42.70, filed Aug. 14, 2018, 5 pages (paper 28).
*Nautilus, Inc.* v. *ICON Health & Fitness, Inc.*, Civil Case No. IPR2017-01363, Current Exhibit List of Patent Owner, filed Aug. 24, 2018, 3 pages (paper 29).
*Nautilus, Inc.* v. *ICON Health & Fitness, Inc.*, Civil Case No. IPR2017-01363, Order Conduct of Proceedings 37 C.F.R. 42.5, filed Aug. 24, 2018, 4 pages (paper 30).
*Nautilus, Inc.* v. *ICON Health & Fitness, Inc.*, Civil Case No. IPR2017-01363, Petitioner's Updated Exhibit List, filed Aug. 24, 2018, 4 pages (paper 31).
*Nautilus, Inc.* v. *ICON Health & Fitness, Inc.*, Civil Case No. IPR2017-01363; Petitioner's Oral Argument Demonstrative Exhibits, filed Aug. 24, 2018, 31 pages (exhibit 1012).
*Nautilus, Inc.* v. *ICON Health & Fitness, Inc.*, Civil Case No. IPR2017-01363; Patent Owner Demonstrative Exhibits; filed Aug. 24, 2018, 10 pages (exhibit 2003).
*Nautilus, Inc.* v. *ICON Health & Fitness, Inc.*, Civil Case No. IPR2017-01407, Petitioner's Motion for Pro Hac Vice Admission, filed Jun. 6, 2018, 5 pages (paper 21).
*Nautilus, Inc.* v. *ICON Health & Fitness, Inc.*, Civil Case No. IPR2017-01407, Patent Owner's Objections to Evidence, filed Jun. 7, 2018, 5 pages (paper 22).
*Nautilus, Inc.* v. *ICON Health & Fitness, Inc.*, Civil Case No. IPR2017-01407, Patent Owner's Notice of Deposition of Christopher Cox, filed Jun. 13, 2018, 3 pages (paper 23).
*Nautilus, Inc.* v. *ICON Health & Fitness, Inc.*, Civil Case No. IPR2017-01407, Order—Granting Motion for Pro Hac Vice Admission, filed Jun. 14, 2018, 4 pages (paper 24).
*Nautilus, Inc.* v. *ICON Health & Fitness, Inc.*, Civil Case No. IPR2017-01407, Petitioner's Updated Mandatory Notices, filed Jun. 20, 2018, 4 pages, (paper 25).
*Nautilus, Inc.* v. *ICON Health & Fitness, Inc.*, Civil Case No. IPR2017-01407, Petitioner's Updated Power of Attorney, filed Jun. 20, 2018, 3 pages, (paper 26).
*Nautilus, Inc.* v. *ICON Health & Fitness, Inc.*, Civil Case No. IPR2017-01407, Patent Owner's Reply to Petitioners Opposition to Motions to Amend, filed Jul. 5, 2018, 28 pages, (paper 27).
*Nautilus, Inc.* v. *ICON Health & Fitness, Inc.*, Civil Case No. IPR2017-01407, Current Exhibit List for Patent Owner, filed Jul. 5, 2018, 4 pages, (paper 28).
*Nautilus, Inc.* v. *ICON Health & Fitness, Inc.*, Civil Case No. IPR2017-01407, Patent Owners Updated Mandatory Notices, filed Jul. 5, 2018, 4 pages, (paper 29).
*Nautilus, Inc.* v. *ICON Health & Fitness, Inc.*, Civil Case No. IPR2017-01407, Petitioner's Notice of Deposition Scott Ganaja, filed Jul. 11, 2018, 3 pages (paper 30).
*Nautilus, Inc.* v. *ICON Health & Fitness, Inc.*, Civil Case No. IPR2017-01407, Joint Notice of Stipulation to Modify Scheduling Order, filed Jul. 12, 2018, 3 pages, (paper 31).
*Nautilus, Inc.* v. *ICON Health & Fitness, Inc.*, Civil Case No. IPR2017-01407, Petitioner's Objections to Evidence, filed Jul. 12, 2018, 4 pages (paper 32).
*Nautilus, Inc.* v. *ICON Health & Fitness, Inc.*, Civil Case No. IPR2017-01407, Petitioner's Amended Notice of Deposition Scott Ganaja, filed Jul. 12, 2018, 3 pages (paper 33).
*Nautilus, Inc.* v. *ICON Health & Fitness, Inc.*, Civil Case No. IPR2017-01407, Order Conduct of Proceeding 37 C.F.R. 42.5, filed Jul. 20, 2018, 5 pages, (paper 34).
*Nautilus, Inc.* v. *ICON Health & Fitness, Inc.*, Civil Case No. IPR2017-01407, Petitioner's Sur-Reply ISO Opposition to Motions to Amend, filed Aug. 1, 2018, 19 pages, (paper 35).
*Nautilus, Inc.* v. *ICON Health & Fitness, Inc.*, Civil Case No. IPR2017-01407, Joint Notice of Stipulation to Modify Scheduling Order, filed Aug. 3, 2018, 3 pages (paper 36).
*Nautilus, Inc.* v. *ICON Health & Fitness, Inc.*, Civil Case No. IPR2017-01407, Order Conduct of the Proceeding, filed Aug. 7, 2018, 4 pages (paper 37).
*Nautilus, Inc.* v. *ICON Health & Fitness, Inc.*, Civil Case No. IPR2017-01407, Patent Owner's Objections to Petitioners Sur Reply, filed Aug. 8, 2018, 5 pages (paper 38).
*Nautilus, Inc.* v. *ICON Health & Fitness, Inc.*, Civil Case No. IPR2017-01407, Patent Owner's Request for Oral Argument, filed Aug. 10, 2018, 4 pages , (paper 39).
*Nautilus, Inc.* v. *ICON Health & Fitness, Inc.*, Civil Case No. IPR2017-01407, Petitioner's Request for Oral Argument, filed Aug. 10, 2018, 4 pages, (paper 40).
*Nautilus, Inc.* v. *ICON Health & Fitness, Inc.*, Civil Case No. IPR2017-01407, Patent Owner's Motion to Exclude Evidence, filed Aug. 10, 2018, 11 pages (paper 41).
*Nautilus, Inc.* v. *ICON Health & Fitness, Inc.*, Civil Case No. IPR2017-01407, Order 37 C.F.R. 42.70, filed Aug. 14, 2018, 5 pages (paper 42).
*Nautilus, Inc.* v. *ICON Health & Fitness, Inc.*, Civil Case No. IPR2017-01407, Petitioner's Opposition to Patent Owner's Motion to Exclude, filed Aug. 16, 2018, 18 pages (paper 44).
*Nautilus, Inc.* v. *ICON Health & Fitness, Inc.*, Civil Case No. IPR2017-01407, Patent Owner's Reply in support of Motion to Exclude, filed Aug. 22, 2018, 8 pages, (paper 45).
*Nautilus, Inc.* v. *ICON Health & Fitness, Inc.*, Civil Case No. IPR2017-01407, Current Exhibit List of Patent Owner, filed Aug. 24, 2018, 4 pages (paper 46).
*Nautilus, Inc.* v. *ICON Health & Fitness, Inc.*, Civil Case No. IPR2017-01407, Order re PO Sur-Rebuttal at Hearing, filed Aug. 24, 2018, 4 pages (paper 47).

(56) References Cited

OTHER PUBLICATIONS

*Nautilus, Inc.* v. *ICON Health & Fitness, Inc.*, Civil Case No. IPR2017-01407, Exhibit 1012—U.S. Pat. No. 8,585,561 (Watt), filed Jun. 4, 2018, 32 pages.
*Nautilus, Inc.* v. *ICON Health & Fitness, Inc.*, Civil Case No. IPR2017-01407, Exhibit 1013—U.S. Pat. No. 9,044,635 (Lull), filed Jun. 4, 2018, 21 pages.
*Nautilus, Inc.* v. *ICON Health & Fitness, Inc.*, Civil Case No. IPR2017-01407, Exhibit 1014—U.S. Pat. No. 7,740,563 (Dalebout), filed Jun. 4, 2018, 31 pages.
*Nautilus, Inc.* v. *ICON Health & Fitness, Inc.*, Civil Case No. IPR2017-01407, Exhibit 1015—US20020055418A1 (Pyles), filed Jun. 4, 2018, 9 pages.
*Nautilus, Inc.* v. *ICON Health & Fitness, Inc.*, Civil Case No. IPR2017-01407, Exhibit 1016—US20120258433A1 (Hope), filed Jun. 4, 2018, 51 pages.
*Nautilus, Inc.* v. *ICON Health & Fitness, Inc.*, Civil Case No. IPR2017-01407, Exhibit 1017—U.S. Pat. No. 7,771,320 (Riley), filed Jun. 4, 2018, 44 pages.
*Nautilus, Inc.* v. *ICON Health & Fitness, Inc.*, Civil Case No. IPR2017-01407, Exhibit 1018—Declaration of Christopher Cox in Support of Petitioners Oppositions to Patent Owners Motions to Amend, filed Jun. 4, 2018, 739 pages.
*Nautilus, Inc.* v. *ICON Health & Fitness, Inc.*, Civil Case No. IPR2017-01407, Exhibit 1019—Affidavit of Lane M. Polozola in Support of Petitioners Motion for Pro Hac Vice Admission, filed Jun. 6, 2018, 4 pages.
*Nautilus, Inc.* v. *ICON Health & Fitness, Inc.*, Civil Case No. IPR2017-01407, Exhibit 1020—S. Ganaja Depo Transcript, filed Aug. 1, 2018, 58 pages.
*Nautilus, Inc.* v. *ICON Health & Fitness, Inc.*, Civil Case No. IPR2017-01407, Exhibit 1021—Petitioner's Demonstrative Exhibits, filed Aug. 24, 2018, 92 pages.
*Nautilus, Inc.* v. *ICON Health & Fitness, Inc.*, Civil Case No. IPR2017-01407, Exhibit 2011—Declaration of Scott Ganaja in Support of Patent Owner's Reply to Petitioners Opposition to Patent Owners Motion to Amend, filed Jul. 5, 2018, 42 pages.
*Nautilus, Inc.* v. *ICON Health & Fitness, Inc.*, Civil Case No. IPR2017-01407, Exhibit 2012—Declaration of Richard Ferraro in Support of Patent Owner's Reply to Petitioners Opposition to Patent Owners Motion to Amend, filed Jul. 5, 2018, 35 pages.
*Nautilus, Inc.* v. *ICON Health & Fitness, Inc.*, Civil Case No. IPR2017-01407, Exhibit 2013—Cox, Christopher Depo Transcript Jun. 26, 2018, filed Jul. 5, 2018, 26 pages.
*Nautilus, Inc.* v. *ICON Health & Fitness, Inc.*, Civil Case No. IPR2017-01407, Exhibit 2014—Patent Owner Demonstrative Exhibits, filed Aug. 24, 2018, 21 pages.
*Nautilus, Inc.* v. *ICON Health & Fitness, Inc.*, Civil Case No. IPR2017-01408, Petitioner's Opposition to Patent Owner's Motion to Amend, filed Jun. 4, 2018, 44 pages (paper 21).
*Nautilus, Inc.* v. *ICON Health & Fitness, Inc.*, Civil Case No. IPR2017-01408, Petitioners Motion for Pro Hac Vice Admission, filed Jun. 6, 2018, 5 pages (paper 22).
*Nautilus, Inc.* v. *ICON Health & Fitness, Inc.*, Civil Case No. IPR2017-01408, Patent Owner's Objections to Evidence, filed Jun. 7, 2018, 5 pages (paper 23).
*Nautilus, Inc.* v. *ICON Health & Fitness, Inc.*, Civil Case No. IPR2017-01408, Declaration R. Lee Rawls, Part 1, dated May 12, 2017, 447 pages, (paper 24).
*Nautilus, Inc.* v. *ICON Health & Fitness, Inc.*, Civil Case No. IPR2017-01408, Declaration R. Lee Rawls, Part 2, dated May 12, 2017, 216 pages, (paper 24).
*Nautilus, Inc.* v. *ICON Health & Fitness, Inc.*, Civil Case No. IPR2017-01408, Order granting Motion for Pro Hac Vice Admission, filed Jun. 14, 2018, 4 pages (paper 25).
*Nautilus, Inc.* v. *ICON Health & Fitness, Inc.*, Civil Case No. IPR2017-01408, Petitioner's Updated Mandatory Notices, filed Jun. 20, 2018, 4 pages, (paper 26).
*Nautilus, Inc.* v. *ICON Health & Fitness, Inc.*, Civil Case No. IPR2017-01408, Petitioner's Updated Power of Attorney, filed Jun. 20, 2018, 3 pages, (paper 27).
*Nautilus, Inc.* v. *ICON Health & Fitness, Inc.*, Civil Case No. IPR2017-01408, Patent Owner's Reply to Opposition to Motions to Amend, filed Jul. 5, 2018, 28 pages, (paper 28).
*Nautilus, Inc.* v. *ICON Health & Fitness, Inc.*, Civil Case No. IPR2017-01408, Current Exhibit List of Patent Owner, filed Jul. 5, 2018, 4 pages, (paper 29).
*Nautilus, Inc.* v. *ICON Health & Fitness, Inc.*, Civil Case No. IPR2017-01408, Patent Owner's Updated Mandatory Notices, filed Jul. 5, 2018, 4 pages, (paper 30).
*Nautilus, Inc.* v. *ICON Health & Fitness, Inc.*, Civil Case No. IPR2017-01408, Petitioner's Notice of Deposition of Scott Ganaja, filed Jul. 11, 2018, 3 pages (paper 31).
*Nautilus, Inc.* v. *ICON Health & Fitness, Inc.*, Civil Case No. IPR2017-01408, Joint Notice of Stipulation to Modify Scheduling Order, filed Jul. 12, 2018, 3 pages (paper 32).
*Nautilus, Inc.* v. *ICON Health & Fitness, Inc.*, Civil Case No. IPR2017-01408, Petitioner's Objections to Patent Owner's Evidence, filed Jul. 12, 2018, 4 pages, (paper 33).
*Nautilus, Inc.* v. *ICON Health & Fitness, Inc.*, Civil Case No. IPR2017-01408, Petitioner's Amended Notice of Deposition of Scott Ganaja, filed Jul. 12, 2018, 3 pages, (paper 34).
*Nautilus, Inc.* v. *ICON Health & Fitness, Inc.*, Civil Case No. IPR2017-01408, Order—Conduct of the Proceeding, 37 C.F.R. 42.5, filed Jul. 20, 2018, 5 pages (paper 35).
*Nautilus, Inc.* v. *ICON Health & Fitness, Inc.*, Civil Case No. IPR2017-01408, Petitioner's Sur-Reply in Support of Opposition to Patent Owners Motions to Amend, filed Aug. 1, 2018, 19 pages, (paper 36).
*Nautilus, Inc.* v. *ICON Health & Fitness, Inc.*, Civil Case No. IPR2017-01408, Joint Notice of Stipulation to Modify Scheduling Order, filed Aug. 3, 2018, 3 pages (paper 37).
*Nautilus, Inc.* v. *ICON Health & Fitness, Inc.*, Civil Case No. IPR2017-01408, Order—Conduct of the Proceeding, 37 C.F.R. 42.5, filed Aug. 7, 2018, 4 pages (paper 38).
*Nautilus, Inc.* v. *ICON Health & Fitness, Inc.*, Civil Case No. IPR2017-01408, Patent Owner's Objections to Petitioners Sur Reply, filed Aug. 2, 2018, 5 pages, (paper 39).
*Nautilus, Inc.* v. *ICON Health & Fitness, Inc.*, Civil Case No. IPR2017-01408, Patent Owner's Request for Oral Argument, filed Aug. 10, 2018, 4 pages, (paper 40).
*Nautilus, Inc.* v. *ICON Health & Fitness, Inc.*, Civil Case No. IPR2017-01408, Petitioner's Request for Oral Argument, filed Aug. 10, 2018, 4 pages, (paper 41).
*Nautilus, Inc.* v. *ICON Health & Fitness, Inc.*, Civil Case No. IPR2017-01408, Patent Owner's Motion to Exclude Evidence, filed Aug. 10, 2018, 11 pages (paper 42).
*Nautilus, Inc.* v. *ICON Health & Fitness, Inc.*, Civil Case No. IPR2017-01408, Order—Oral Hearing 37 C.F.R. 42.70, filed Aug. 14, 2018, 5 pages (paper 43).
*Nautilus, Inc.* v. *ICON Health & Fitness, Inc.*, Civil Case No. IPR2017-01408, Petitioner's Opposition to Patent Owner's Motion to Exclude Evidence, filed Aug. 16, 2018, 18 pages (paper 44).
*Nautilus, Inc.* v. *ICON Health & Fitness, Inc.*, Civil Case No. IPR2017-01408, Patent Owners Reply in Support of its Motion to Exclude, filed Aug. 22, 2018, 8 pages, (paper 46).
*Nautilus, Inc.* v. *ICON Health & Fitness, Inc.*, Civil Case No. IPR2017-01408, Current Exhibit List of Patent Owner, filed Aug. 24, 2018, 4 pages (paper 47).
*Nautilus, Inc.* v. *ICON Health & Fitness, Inc.*, Civil Case No. IPR2017-01408, Order Conduct of the Proceedings—37 C.F.R. 42.5, filed Aug. 24, 2018, 4 pages, (paper 48).
*Nautilus, Inc.* v. *ICON Health & Fitness, Inc.*, Civil Case No. IPR2017-01408, Petitioner's Updated Exhibit List, filed Aug. 24, 2018, 5 pages, (paper 49).
*Nautilus, Inc.* v. *ICON Health & Fitness, Inc.*, Civil Case No. IPR2017-01408, Exhibit 1012—U.S. Pat. No. 8,585,561 (Watt), filed Jun. 4, 2018, 32 pages.
*Nautilus, Inc.* v. *ICON Health & Fitness, Inc.*, Civil Case No. IPR2017-01408, Exhibit 1013—U.S. Pat. No. 9,044,635 (Lull), filed Jun. 4, 2018, 21 pages.

(56) References Cited

OTHER PUBLICATIONS

*Nautilus, Inc.* v. *ICON Health & Fitness, Inc.*, Civil Case No. IPR2017-01408, Exhibit 1014—U.S. Pat. No. 7,740,563 (Dalebout), filed Jun. 4, 2018, 31 pages.
*Nautilus, Inc.* v. *ICON Health & Fitness, Inc.*, Civil Case No. IPR2017-01408, Exhibit 1015—US20020055418A1 (Pyles), filed Jun. 4, 2018, 9 pages.
*Nautilus, Inc.* v. *ICON Health & Fitness, Inc.*, Civil Case No. IPR2017-01408, Exhibit 1016—US20120258433A1 (Hope), filed Jun. 4, 2018, 51 pages.
*Nautilus, Inc.* v. *ICON Health & Fitness, Inc.*, Civil Case No. IPR2017-01408, Exhibit 1017—U.S. Pat. No. 7,771,320 (Riley), filed Jun. 4, 2018, 44 pages.
*Nautilus, Inc.* v. *ICON Health & Fitness, Inc.*, Civil Case No. IPR2017-01408, Exhibit 1018—Declaration of Christopher Cox in Support of Petitioners Oppositions to Patent Owners Motions to Amend, filed Jun. 4, 2018, 739 pages.
*Nautilus, Inc.* v. *ICON Health & Fitness, Inc.*, Civil Case No. IPR2017-01408, Exhibit 1019—Affidavit of Lane M. Polozola in Support of Petitioners Motion for Pro Hac Vice Admission, filed Jun. 6, 2018, 4 pages.
*Nautilus, Inc.* v. *ICON Health & Fitness, Inc.*, Civil Case No. IPR2017-01408, Exhibit 1020—Scott Ganaja Depo Transcript, filed Aug. 1, 2018, 58 pages.
*Nautilus, Inc.* v. *ICON Health & Fitness, Inc.*, Civil Case No. IPR2017-01408, Exhibit 1021—Petitioner's Demonstrative Exhibits, filed Aug. 24, 2018, 92 pages.
*Nautilus, Inc.* v. *ICON Health & Fitness, Inc.*, Civil Case No. IPR2017-01408, Exhibit 2011—Declaration of Scott Ganaja in Support of Patent Owner's Reply to Petitioner's Opposition to Patent Owner's Motion to Amend, filed Jul. 5, 2018, 42 pages.
*Nautilus, Inc.* v. *ICON Health & Fitness, Inc.*, Civil Case No. IPR2017-01408, Exhibit 2012—Declaration of Richard Ferraro in Support of Patent Owner's Reply to Petitioner's Opposition to Patent Owner's Motion to Amend, filed Jul. 5, 2018, 35 pages.
*Nautilus, Inc.* v. *ICON Health & Fitness, Inc.*, Civil Case No. IPR2017-01408, Exhibit 2013—Cox, Christopher Depo Transcript Jun. 26, 2018, filed Jul. 5, 2018, 26 pages.
*Nautilus, Inc.* v. *ICON Health & Fitness, Inc.*, Civil Case No. IPR2017-01408, Exhibit 2014—Patent Owner's Demonstrative Exhibits, filed Aug. 24, 2018, 21 pages.
European Patent Office, Article 94(3) EPC Communication dated Jul. 10, 2018, issued in European Patent Application No. 14768130.8-1126, 3 pages.
United States Patent and Trademark Office; International Search Report and Written Opinion issued in application No. PCT/US2015/034665; dated Oct. 8, 2015 (14 pages).
*Nautilus, Inc.* v. *ICON Health & Fitness, Inc.*, Civil Case Nos. IPR2017-01363, IPR2017-01407, and IPR2017-01408 Record of Oral Hearing held Aug. 29, 2018; (paper 32) 104 pages.
*Nautilus, Inc.* v. *ICON Health & Fitness, Inc.*, Civil Case No. IPR2017-01407—Petitioner's Updated Exhibit List, filed Aug. 24, 2018, (paper 48) 5 pages.
*Nautilus, Inc.* v. *ICON Health & Fitness, Inc.*, Civil Case No. IPR2017-01363, Final Written Decision dated Nov. 28, 2018; (paper 33) 29 pages.
*Nautilus, Inc.* v. *ICON Health & Fitness, Inc.*, Civil Case Nos. IPR2017-01407, Final Written Decision dated Dec. 3, 2018; (paper 50) 81 pages.
*Nautilus, Inc.* v. *ICON Health & Fitness, Inc.*, Civil Case Nos. IPR2017-01408, Final Written Decision dated Dec. 3, 2018; (paper 51) 82 pages.
U.S. Appl. No. 16/572,272, filed Sep. 16, 2019, titled "Cable Exercise Machine", (35 pages).
U.S. Appl. No. 62/310,467, filed Mar. 18, 2016, titled "Collapsible Strength Exercise Machine", 31 pages.
U.S. Appl. No. 62/429,977, filed Dec. 5, 2016, titled "Pull Cable Resistance Mechanism in a Treadmill", 37 pages.
U.S. Appl. No. 62/429,970, filed Dec. 5, 2016, titled "Tread Belt Locking Mechanism", 37 pages.
International Bureau of WIPO; International Preliminary Report on Patentability; Int'l App No. PCT/US2017/064523 dated Jun. 11, 2019; 7 pages.
International Bureau of WIPO; International Preliminary Report on Patentability; Int'l App No. PCT/US2017/064536 dated Jun. 11, 2019; 8 pages.
Chinese Second Office Action for Chinese Patent Application No. 201480003701.9 dated Nov. 21, 2016.
Chinese Third Office Action for Chinese Patent Application No. 201480003701.9 dated Nov. 24, 2017.
Chinese Office Action for Chinese Patent Application No. 201580033332 dated Feb. 28, 2018.
Chinese Second Office Action for Chinese Patent Application No. 201580033332 dated Nov. 15, 2018.
Nordic Track Fusion CST Series; website; located at: http://www/nordictrack.com/fusion-cst-series; accessed on Jan. 24, 2018; 11 pages.
U.S. Appl. No. 62/804,146, filed Feb. 11, 2019, titled Cable and Power Rack Exercise Machine, 49 pages.
U.S. Appl. No. 16/780,765, filed Feb. 3, 2020, titled Cable and Power Rack Exercise Machine, 48 pages.
U.S. Appl. No. 16/787,850, filed Feb. 11, 2020, titled "Exercise Machine", 40 pages.
International Patent Application No. PCT/US20/17710, filed Feb. 11, 2020, titled "Exercise Machine", 41 pages.
First Office Action and Search Report with English translation issued in Taiwan application 106135830 dated Jun. 15, 2018.
U.S. Appl. No. 16/742,762, filed Jan. 14, 2020, titled Controlling an Exercise Machine Using a Video Workout Program, 146 pages.
U.S. Appl. No. 16/750,925, filed Jan. 2, 2020, titled Systems and Methods for an Interactive Pedaled Exercise Device, 54 pages.
U.S. Appl. No. 62/914,007, filed Oct. 11, 2019, titled Modular Exercise Device, 128 pages.
U.S. Appl. No. 62/934,291, filed Nov. 12, 2019, titled Exercise Storage System, 41 pages.
U.S. Appl. No. 62/934,297, filed Nov. 12, 2019, titled Exercise Storage System, 44 pages.
Extended European Search Report for European Application No. 17879180.2, dated Jun. 9, 2020, 8 pages.
Chinese First Office Action for Application No. 201780074846.1 dated May 9, 2020.
International Search Report and Written Opinion dated Aug. 20, 2020 issued in International Application No. PCT/US20/17710, 10 pages.
U.S. Appl. No. 29/568,648, filed Jun. 20, 2016, ICON Health & Fitness, Inc.
U.S. Appl. No. 29/702,127, filed Sep. 16, 2019, ICON Health & Fitness, Inc.
U.S. Appl. No. 13/088,007, filed Apr. 15, 2011, Scott R. Watterson.
U.S. Appl. No. 15/821,386, filed Nov. 22, 2017, ICON Health & Fitness, Inc.
U.S. Appl. No. 15/973,176, filed May 7, 2018, Melanie Douglass.
U.S. Appl. No. 16/378,022, filed Apr. 8, 2019, William T. Dalebout.
U.S. Appl. No. 16/435,104, filed Jun. 7, 2019, Dale Alan Buchanan.
U.S. Appl. No. 16/506,085, filed Jul. 9, 2019, ICON Health & Fitness, Inc.
U.S. Appl. No. 62/697,833, filed Jul. 13, 2018, ICON Health & Fitness, Inc.
U.S. Appl. No. 62/796,952, filed Jan. 25, 2019, ICON Health & Fitness, Inc.
U.S. Appl. No. 62/804,146, filed Feb. 11, 2019, ICON Health & Fitness, Inc.
U.S. Appl. No. 62/804,685, filed Feb. 12, 2019, ICON Health & Fitness, Inc.
U.S. Appl. No. 62/852,118, filed May 22, 2019, David Hays.
U.S. Appl. No. 62/866,576, filed Jun. 25, 2019, ICON Health & Fitness, Inc.
U.S. Appl. No. 62/887,391, filed Aug. 15, 2019, ICON Health & Fitness, Inc.
U.S. Appl. No. 62/887,398, filed Aug. 15, 2019, ICON Health & Fitness, Inc.
U.S. Appl. No. 62/897,113, filed Sep. 9, 2019, ICON Health & Fitness, Inc.

(56) References Cited

OTHER PUBLICATIONS

U.S. Appl. No. 62/842,118, filed May 23, 2019, ICON Health & Fitness, Inc.
English Translation of Search Report for Taiwan Patent Application No. 104131458 dated Jun. 3, 2016.
English Translation of Search Report for Taiwan Patent Application No. 105126694 dated Oct. 3, 2017.
International Search Report and Written Opinion issued in PCT/US2016/048692 dated Dec. 1, 2016.
International Search Report and Written Opinion issued in PCT/US2017/023002 dated Jun. 28, 2017.
International Search Report and Written Opinion issued in PCT/US2017/022989 dated May 23, 2017.

STRENGTH TRAINING APPARATUS

CROSS REFERENCE TO RELATED APPLICATIONS

This application is a continuation of U.S. application Ser. No. 16/923,275, filed on Jul. 8, 2020, which is a continuation of U.S. application Ser. No. 16/404,413, filed on May 6, 2019, now U.S. Pat. No. 10,709,925, which is a continuation of U.S. application Ser. No. 15/472,954, filed on Mar. 29, 2017, now U.S. Pat. No. 10,279,212, which is a continuation of U.S. application Ser. No. 15/019,088, filed on Feb. 9, 2016, now U.S. Pat. No. 9,616,276, which is a continuation of U.S. application Ser. No. 14/213,793, filed on Mar. 14, 2014, now U.S. Pat. No. 9,254,409, which claims priority to U.S. Provisional Patent Application No. 61/786,007, filed on Mar. 14, 2013. Each of the aforementioned applications is incorporated herein by reference in its entirety.

TECHNICAL FIELD

The present disclosure relates to exercise equipment. More particularly, the present disclosure relates to strength training equipment and to related methods.

BACKGROUND

While there are numerous exercise activities that one may participate in, exercise may be broadly broken into the categories of aerobic exercise and anaerobic exercise. Aerobic exercise generally refers to activities that substantially increase the heart rate and respiration of the exerciser for an extended period of time. This type of exercise is generally directed to enhancing cardiovascular performance. Such exercise usually includes low or moderate resistance to the movement of the individual. For example, aerobic exercise includes activities such as walking, running, jogging, swimming or bicycling for extended distances and extended periods of time.

Anaerobic exercise generally refers to exercise that strengthens skeletal muscles and usually involves the flexing or contraction of targeted muscles through significant exertion during a relatively short period of time and/or through a relatively small number of repetitions. For example, anaerobic exercise includes activities such as weight training, push-ups, sit-ups, pull-ups or a series of short sprints.

When exercising at home or in a gym, aerobic and anaerobic exercise usually involves the use of different types of equipment. For example, aerobic exercise usually involves equipment such as treadmills, ellipticals and bicycles (traditional and stationary) while anaerobic exercise often involves the use of free weights, weight stacks, or other cable and pulley resistance-type systems.

Often, individuals will plan their work-out routines to include both aerobic and anaerobic activities. For example, a person may do anaerobic exercises (e.g., weight lifting and other strength training exercises) on two or three days of the week while doing aerobic exercising (e.g., running, bicycling) on the remaining days of the week. In other instances, an individual may do both aerobic and anaerobic activities during the same day.

One of the difficulties in integrating both aerobic and anaerobic activities is the ability of an individual to efficiently and effectively track their progress. For example, many individuals use aerobic exercise equipment such as a treadmill or an elliptical machine to automatically track the calories that they've burned while using such equipment.

However, it is more difficult to track or calculate such information when doing strength training exercises.

A couple of examples of equipment that has tried to combine aerobic exercising with anaerobic exercising are described in U.S. Pat. No. 5,527,245 to Dalebout et al. and U.S. Pat. No. 7,740,563 to Dalebout et al. These patents describe a resistance-type strength training apparatus combined with, in one instance, a treadmill, and in another instance an elliptical device.

In view of the foregoing, it would be desirable to provide the ability to track one's progress during exercise in a manner that is applicable to both aerobic and anaerobic activities and which is simple and effective. Additionally, it is a general desire in the industry to provide exercise equipment with new features and enhanced performance.

SUMMARY

In one aspect of the disclosure, a strength training apparatus includes a first arm and a second arm each being configured to be selectively pivoted independent of each other at multiple angles relative to each other, a first pulley coupled to an end of the first arm, a first cable extending through the first arm and the first pulley, a second pulley coupled to an end of the second arm, a second cable extending through the second arm and the second pulley, and an electronic control panel configured to allow for multiple levels of resistance to a user pulling on the first cable and/or the second cable. The electronic control panel includes a processor and a memory configured to control a current level of resistance, an electronic input device configured to allow the user to set the current level of resistance, and an electronic output device configured to display the current level of resistance.

In one aspect of the disclosure, a strength training apparatus includes a base member and a tower structure coupled with the base member.

In one or more other aspects that may be combined with any of the aspects herein, may further include at least one arm that is pivotally coupled with the tower structure.

In one or more other aspects that may be combined with any of the aspects herein, may further include a flywheel and a cable and pulley system associated with the at least one arm, wherein displacement of at least one cable of the cable and pulley system affects rotation of the flywheel.

In one or more other aspects that may be combined with any of the aspects herein, may further include a braking mechanism associated with a flywheel and configured to apply a selected resistance to the rotation of the flywheel.

In one or more other aspects that may be combined with any of the aspects herein, may further include a braking mechanism including a magnetic braking mechanism.

In one or more other aspects that may be combined with any of the aspects herein, may further include a torque sensor associated with the flywheel.

In one or more other aspects that may be combined with any of the aspects herein, may further include a console having at least one input device and at least one output device.

In one or more other aspects that may be combined with any of the aspects herein, may further include the console in communication with the braking mechanism, wherein the at least one input device controls the amount of resistance applied to the flywheel by the braking mechanism.

In one or more other aspects that may be combined with any of the aspects herein, may further include the console in communication with the torque sensor, wherein the at least one output device provides an indication of the amount of work expended by a user upon rotation of the flywheel.

In one or more other aspects that may be combined with any of the aspects herein, may further include the at least one output device provides the indication of the amount of work expended in units of watts.

In one or more other aspects that may be combined with any of the aspects herein, may further include the strength training apparatus including a drive mechanism associated with the flywheel.

In one or more other aspects that may be combined with any of the aspects herein, may further include a clutch mechanism coupled with the flywheel by way of a drive belt.

In one or more other aspects that may be combined with any of the aspects herein, may further include the clutch mechanism enabling the rotation of the flywheel in a first rotational direction upon the displacement of the at least one cable in a first defined direction, but has no effect on the flywheel upon displacement of the at least one cable in a second defined direction, the second defined direction being the opposite of the first defined direction.

In one or more other aspects that may be combined with any of the aspects herein, may further include the drive mechanism having a drive chain coupled with the cable and pulley system, wherein the drive chain extends about a plurality of sprockets including at least one sprocket that is displaceable relative to the tower.

In one or more other aspects that may be combined with any of the aspects herein, may further include at least one biasing member coupled with the at least one displaceable sprocket.

In one or more other aspects that may be combined with any of the aspects herein, may further include an embodiment where the at least one arm includes a pair of arms, wherein the cable and pulley system includes a first pulley coupled with a first arm of the pair of arms with a first cable extending through the first pulley and a second pulley coupled with the second arm with a second cable extending through the second pulley.

In one or more other aspects that may be combined with any of the aspects herein, may further include the pair of arms maintained in a fixed angular position relative to each other.

In another aspect of the disclosure, a method of conducting strength training includes applying a force to a cable and displacing the cable in a first direction and affecting rotation of a flywheel upon displacement of the cable.

In one or more other aspects that may be combined with any of the aspects herein, may further include a resistance applied to the flywheel and the torque applied to the flywheel being measured, such as by way of a sensor.

In one or more other aspects that may be combined with any of the aspects herein, may further include calculating the work performed, in watts, based at least in part on the measured torque.

In one or more other aspects that may be combined with any of the aspects herein, may further include applying resistance to the flywheel by applying resistance using a magnetic brake.

In one or more other aspects that may be combined with any of the aspects herein, may further include the resistance applied by the magnetic brake being selectively varied.

In one or more other aspects that may be combined with any of the aspects herein, may further include applying a force to a cable including pulling the cable through a pulley, and selectively positioning the pulley at one of a variety of positions prior to pulling the cable through the pulley.

In one or more other aspects that may be combined with any of the aspects herein, may further include a method of tracking work expended during exercising including conducting an aerobic exercise activity and determining the work expended during the aerobic exercise activity and expressing the work expended in units of watts.

In one or more other aspects that may be combined with any of the aspects herein, may further include an embodiment where an anaerobic exercise activity is conducted and the work expended during the anaerobic exercise activity is determined and expressed in units of watts.

In one or more other aspects that may be combined with any of the aspects herein, may further include summing the amount of work expended during the aerobic activity and the amount of work expended during the anaerobic activity.

BRIEF DESCRIPTION OF THE DRAWINGS

The accompanying drawings illustrate various embodiments of the present methods and systems and are a part of the specification. The illustrated embodiments are merely examples of the present systems and methods and do not limit the scope thereof.

Throughout the drawings, identical reference numbers designate similar, but not necessarily identical, elements.

DETAILED DESCRIPTION

Figure 1:
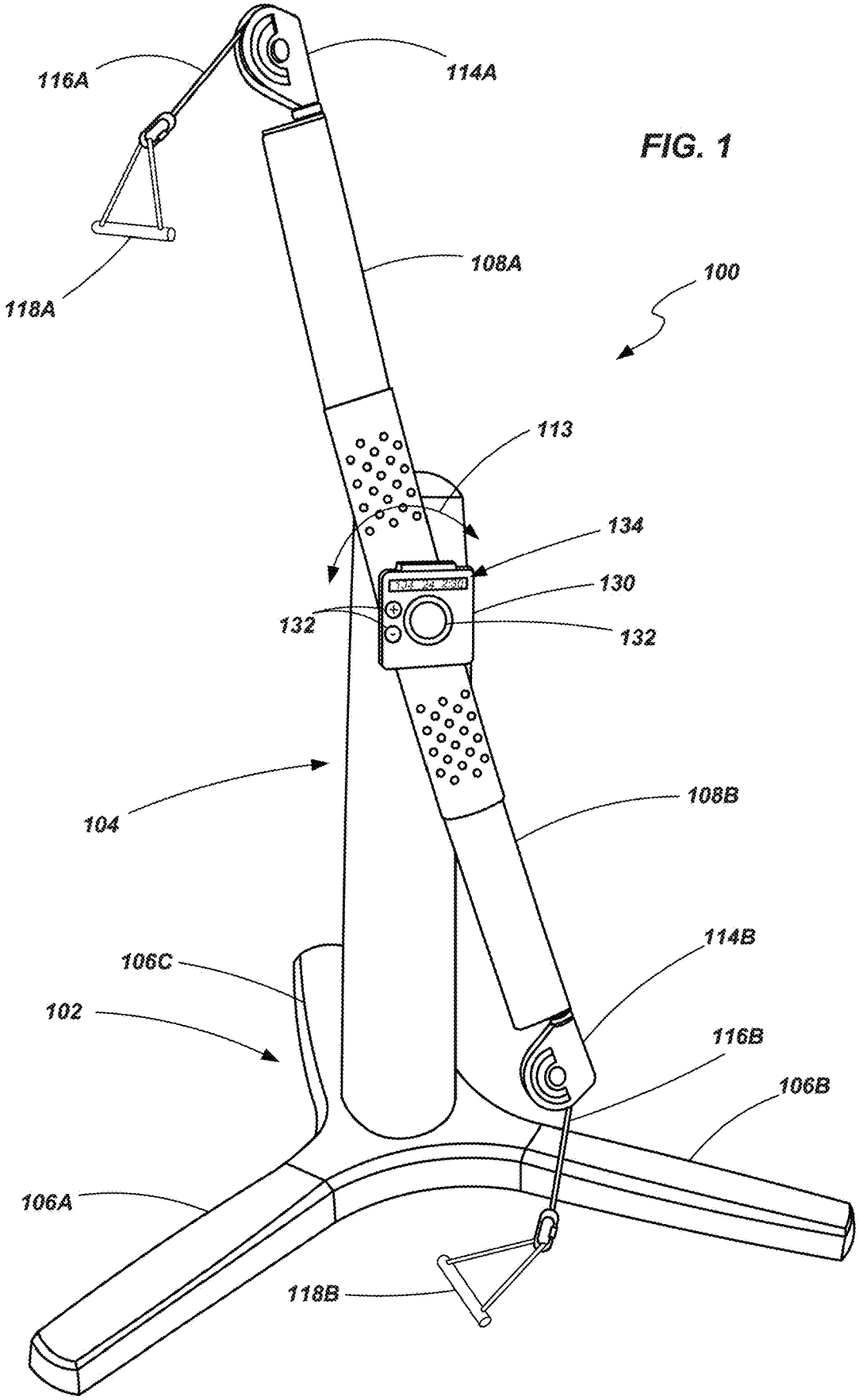
FIG. 1 is a perspective view of a strength training apparatus.
Figure 2:
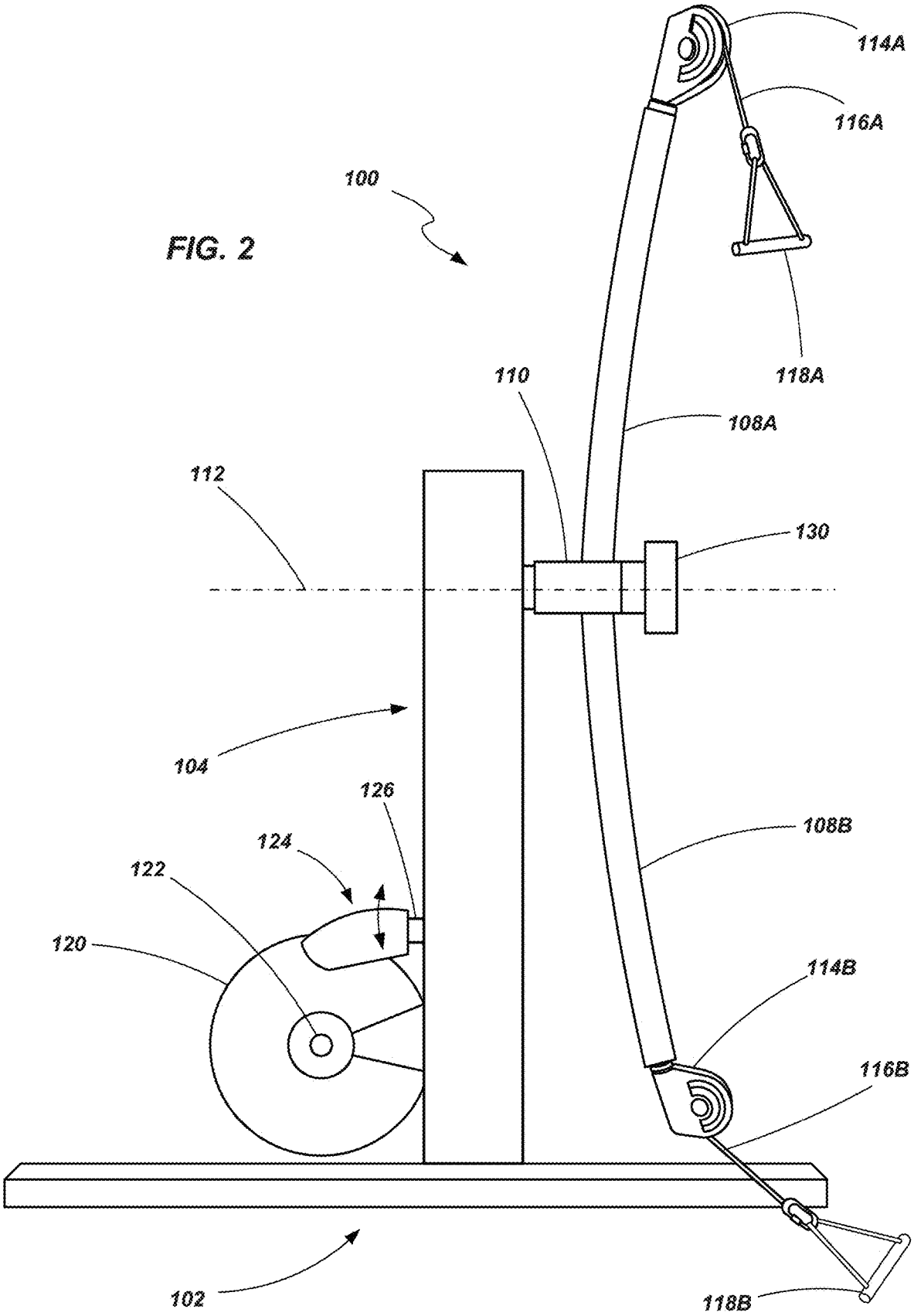
FIG. 2 is a first side view of the strength training apparatus shown in FIG. 1.
Figure 3:
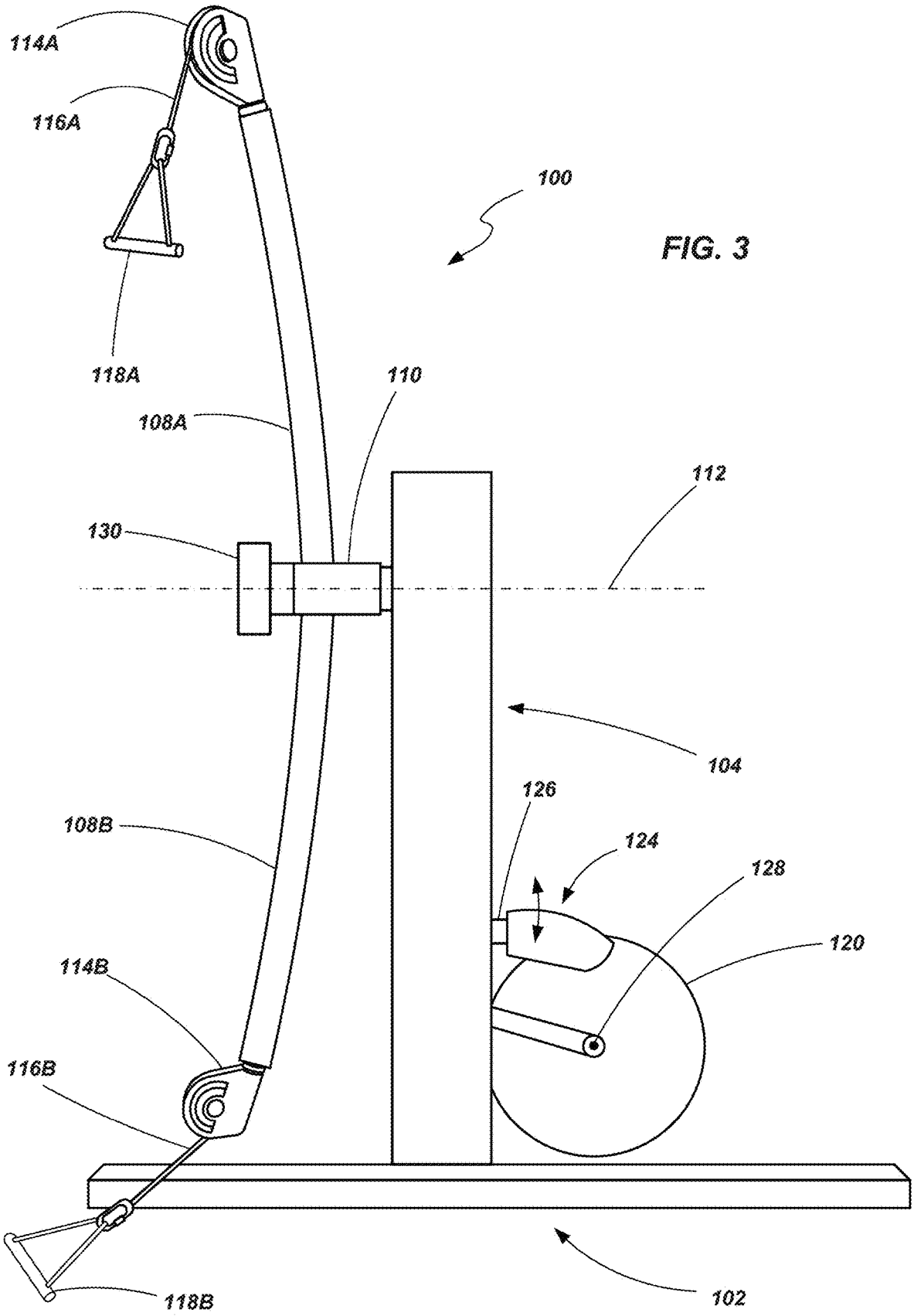
FIG. 3 is another side view of the strength training apparatus shown in FIG. 1.

Referring to FIGS. 1-3, a strength training apparatus 100 is provided. The apparatus 100, according to certain embodiments, includes a base member 102 and a tower 104 or support structure coupled to, and extending upward from, the base member 102. The base may be configured to include a plurality of legs 106A-106C extending away from each other to provide a stable base or platform for the apparatus 100 and to support the apparatus 100 when forces are applied to it by someone using the apparatus 100 to exercise. In the embodiment shown in FIGS. 1-3, the base member 102 includes three legs. However, it is noted that other configurations are contemplated.

A pair of arms 108A and 108B are pivotally coupled to the tower 104 by way of a bearing 110 or other mechanical structure. The bearing 110 enables the arms 108A and 108B to rotate about a defined axis 112 (FIGS. 2 and 3) relative to the tower 104 and base member 102 as indicated by directional arrow 113 (FIG. 1). In one embodiment, the arms 108A and 108B may be configured to maintain a constant angular relationship relative to each other as they are rotated about the axis 112 (e.g., they may continually extend in substantially opposite directions from each other). In another embodiment, each arm 108A and 108B may be selectively positionable (manually, or by a motor or other actuator (not shown)) independent of the other so that they may be positioned at any of a variety of angles relative to each other.

The apparatus 100 also includes a pair of pulleys 114A and 114B, one being pivotally coupled to the end of each arm 108A and 108B. Cables 116A and 116B extend through each pulley 114A and 114B and are coupled with handles 118A and 118B. As will be described in further detail below, the handles 118A and 118B, the cables 116A and 116B and the pulleys 114A and 114B are part of a cable/pulley system that provides resistance to an individual that is using the apparatus 100 for strength training.

As seen in FIGS. 2 and 3, a flywheel 120 is coupled to either the base member 102 or the tower 104 (or to both) and configured to rotate about a shaft 122. A resistance or braking mechanism 124 is positioned adjacent the flywheel 120 and is selectively adjustable so as to apply a desired level of resistance to the rotation of the flywheel 120. Various types of braking mechanisms may be used including, in one embodiment, straps or pads that apply friction to the flywheel 120. In one embodiment, a magnetic brake (sometimes referred to as an eddy current brake) may be used to provide an adjustable level of resistance applied to the flywheel 120.

When the braking mechanism 124 is configured as a magnetic mechanism it may include an arm 126 that is pivotally coupled with the tower 104 and which contains a plurality of magnets arranged to provide a desired magnetic flux. As the arm 126 is rotated relative to tower 104 (and, thus, the flywheel 120), the magnetic flux through which the flywheel 120 rotates changes, thereby altering the amount of rotational resistance experienced by the flywheel 120.

The flywheel 120, when configured to interact with a magnetic braking mechanism, may include ferrous components, non-ferrous components, or both. In one embodiment, the flywheel 120 may include a relatively dense ferrous component to impart a desired level of rotational inertia to the flywheel 120. The flywheel 120 may also include a nonferrous component to provide increased braking resistance when used with a magnetic brake mechanism. For example, one embodiment may include a portion that is formed of cast iron (a ferrous material) to provide the desired rotational inertia with another portion formed of an aluminum material (to provide increased braking response to the magnetic mechanism). One such configuration of a flywheel, as well as an associated magnetic braking mechanism, is described by U.S. Patent Application Publication No. 2012/0088638 to Lull (application Ser. No. 13/267,719), the disclosure of which is incorporated by reference herein in its entirety.

A torque sensor 128 may be associated with the shaft 122 to determine the amount of torque applied to the flywheel 120 by a drive mechanism (discussed below). Various types of torque sensors may be utilized. One example of a torque sensor includes that which is described in U.S. Pat. No. 7,011,326 to Schroeder et al., the disclosure of which is incorporated by reference herein in its entirety. Another example of a torque sensor includes that which is described in U.S. Pat. No. 7,584,673 to Shimizu, the disclosure of which is incorporated by reference herein in its entirety.

The apparatus further includes a control panel 130 which may be located adjacent the bearing 110 or some other convenient location (e.g., on the tower 104). The control panel 130 may include various input devices 132 (e.g., buttons, switches or dials) and output devices 134 (e.g., LED lights, displays, alarms) to provide means of interaction with a user of the apparatus 100. The control panel 130 may further include connections for communication with other devices. The controller may include a processor and memory to provide various functions in controlling components of the apparatus 100 (e.g., the braking mechanism), in communicating with various components (e.g., the torque sensor) and making certain calculations as will be discussed below.

In one example, one of the input devices 132 of the control panel 130 may be used to set a desired resistance level that is to be applied to the flywheel 120 by controlling an actuating member associated with the braking mechanism 124. An output device 134 (e.g., a display) may indicate the current or selected level of resistance. An output device 134 of the control panel 130 may also provide an indication of the amount of work performed within a period of time calculated, for example, based on the torque applied to the flywheel 120 as measured by the torque sensor 128.

Figure 4A:
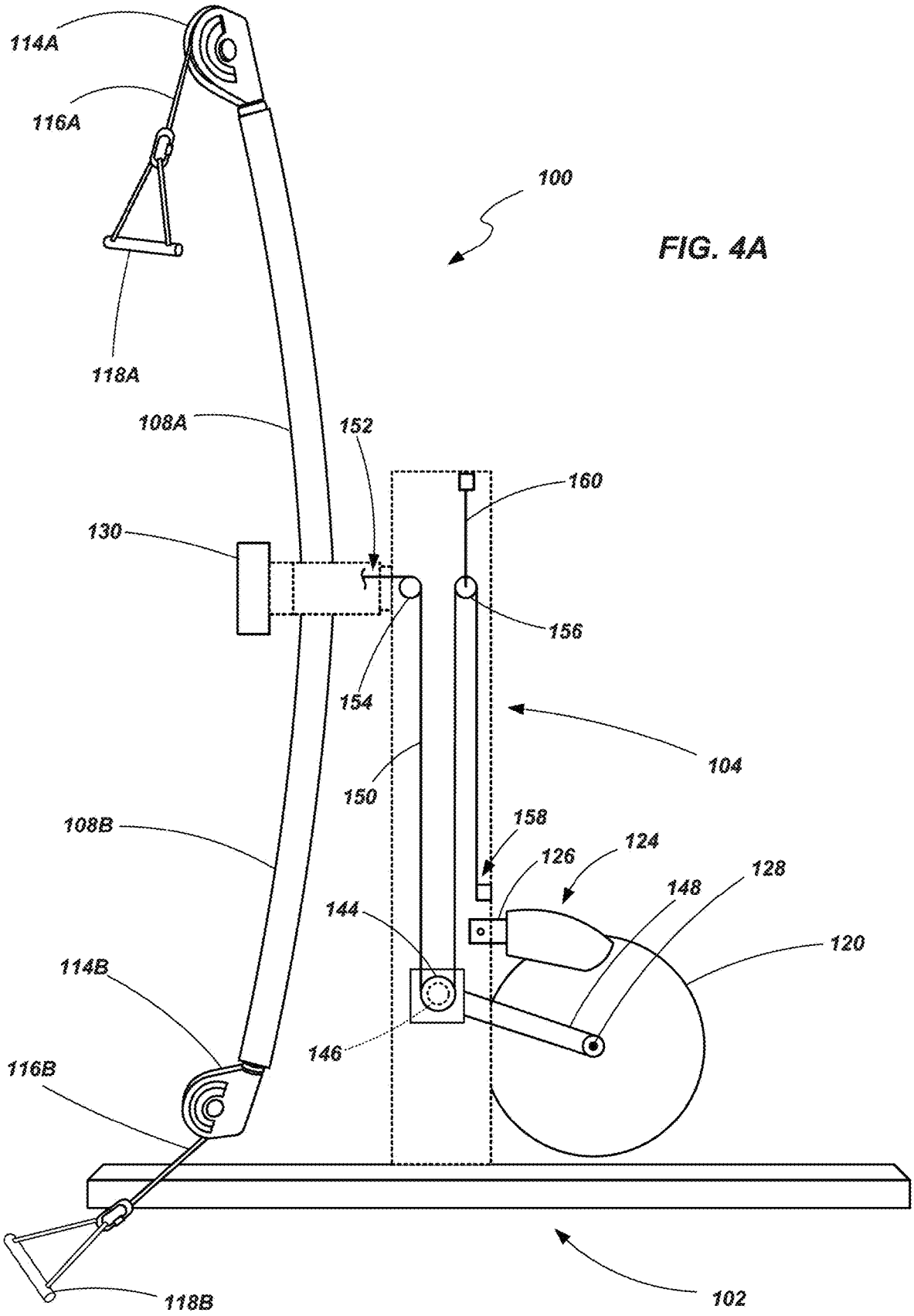
FIGS. 4A and 4B show a side view and a rear view, respectively, of the apparatus shown in FIG. 1, including various components, when the apparatus is in a first state.
Figure 4B:
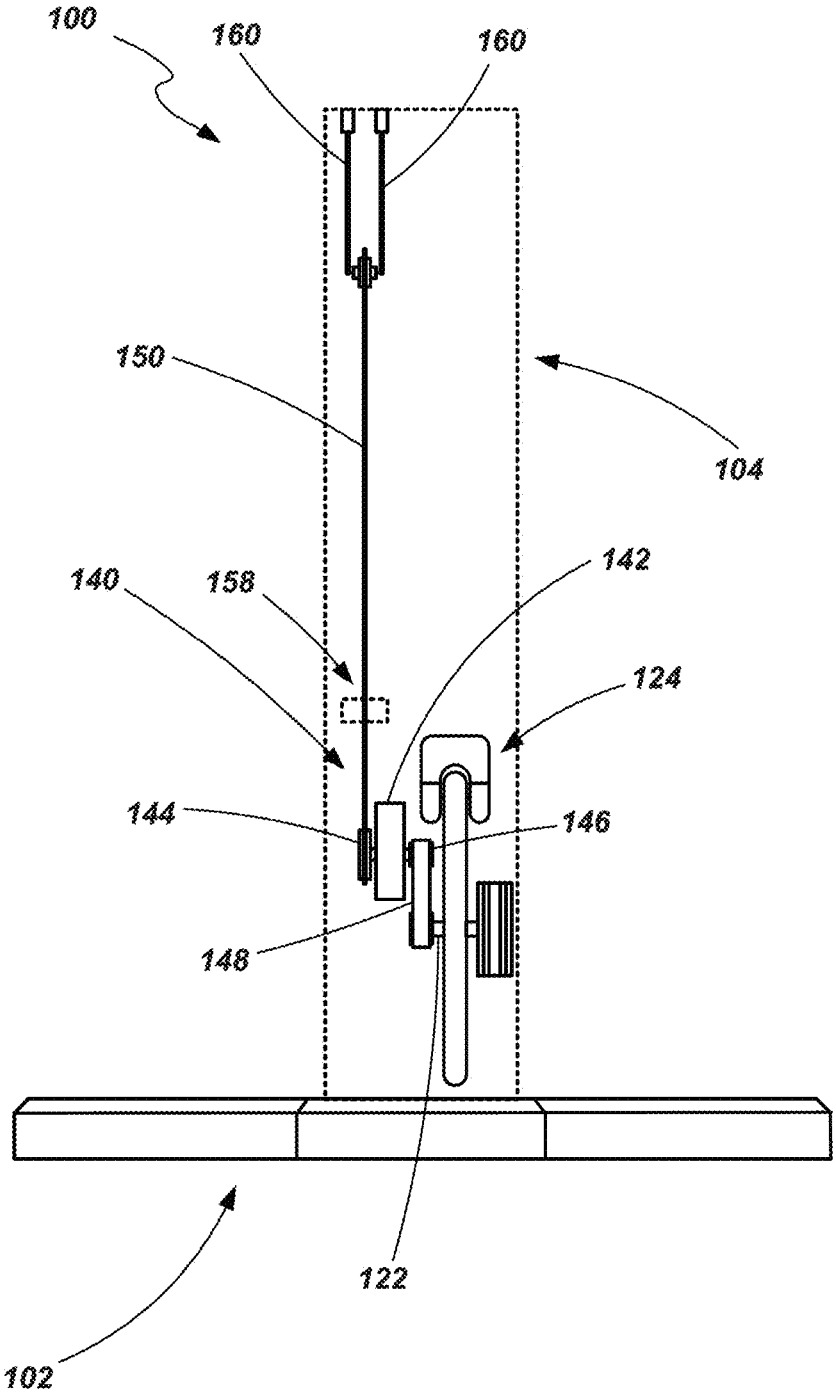

Referring now to FIGS. 4A and 4B, a side view and a rear view of the apparatus 100 is shown with various components which may be disposed within the tower 104 or otherwise arranged to assist in driving flywheel 120. It is noted that FIG. 4B does not depict the arms 108A and 108B (and associated components) for purposes of clarity and convenience. A drive mechanism 140 may include a clutch mechanism 142 having an input shaft 144 and an output shaft 146. A drive belt 148 (or drive chain or other similar drive structure) may extend about the output shaft 146 and also about the shaft 122 of the flywheel 120 (or associated pulleys coupled with the shafts). The clutch mechanism 142 is configured such that, when the input shaft 144 is rotated in a first specified direction, the output shaft 146 is likewise rotated in a specified direction displacing the drive belt 148 and, ultimately, driving the flywheel 120 in a desired direction. However, if the input shaft 144 is rotated in a second direction, opposite that of the first direction, it has no effect on the output shaft 146. Rather, the output shaft 146 is enabled to continue rotating in its initially specified direction and does not reverse directions. It is noted that, in other embodiments, the clutch mechanism 142 may be coupled directly to the flywheel 120.

A drive chain 150 (or drive belt or cable or other appropriate structure) has a first end 152 that is coupled to the cables 116A and 116B that extend through pulleys 114A and 114B and either extend through, or adjacent to, the arms 108A and 108B. The drive chain 150 extends through several pulleys or sprockets including, for example, a first sprocket 154, the input shaft 144 (or an associated pulley or sprocket coupled therewith) and a second sprocket 156. A second end 158 of the drive chain 150 may be fixed, for example, to a frame or other component associated with the tower 104. In the embodiment shown in FIGS. 4A and 4B, the first sprocket 154 is rotatable about an axis which is fixed relative to the tower 104. The second sprocket 156 is rotatable about an axis which is displaceable relative to the tower 104. For example, one or more biasing members 160 may be coupled between the second sprocket 156 and the tower 104 (or some component thereof) enabling the second sprocket 156 to be displaced relative to the tower 104. Guide members may be used to help constrain or control the displacement of the sprocket along a desired path.

Figure 5A:
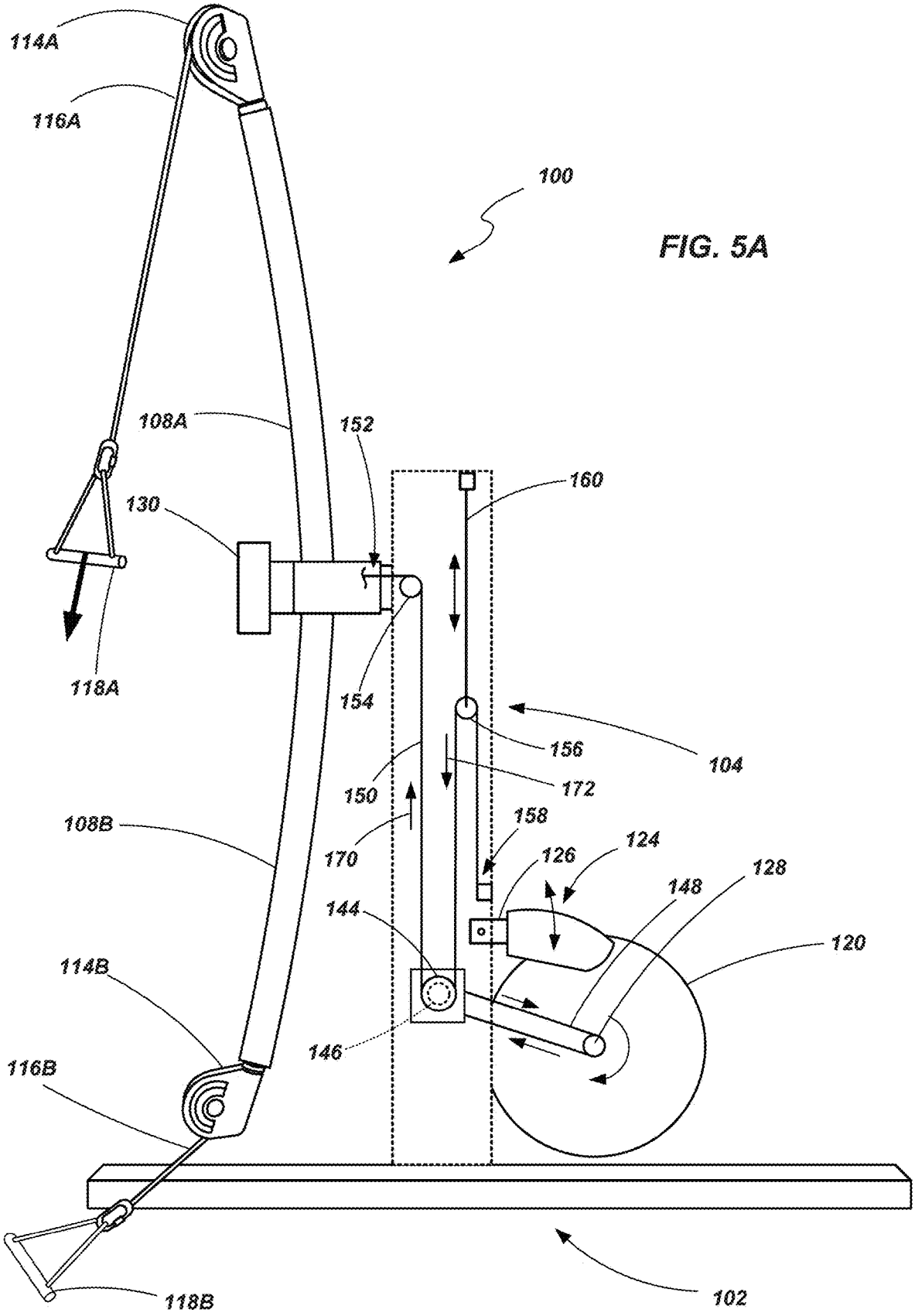
FIGS. 5A and 5B show a side view and a rear view, respectively, of the apparatus shown in FIG. 1, including various components, when the apparatus is in a second state.
Figure 5B:
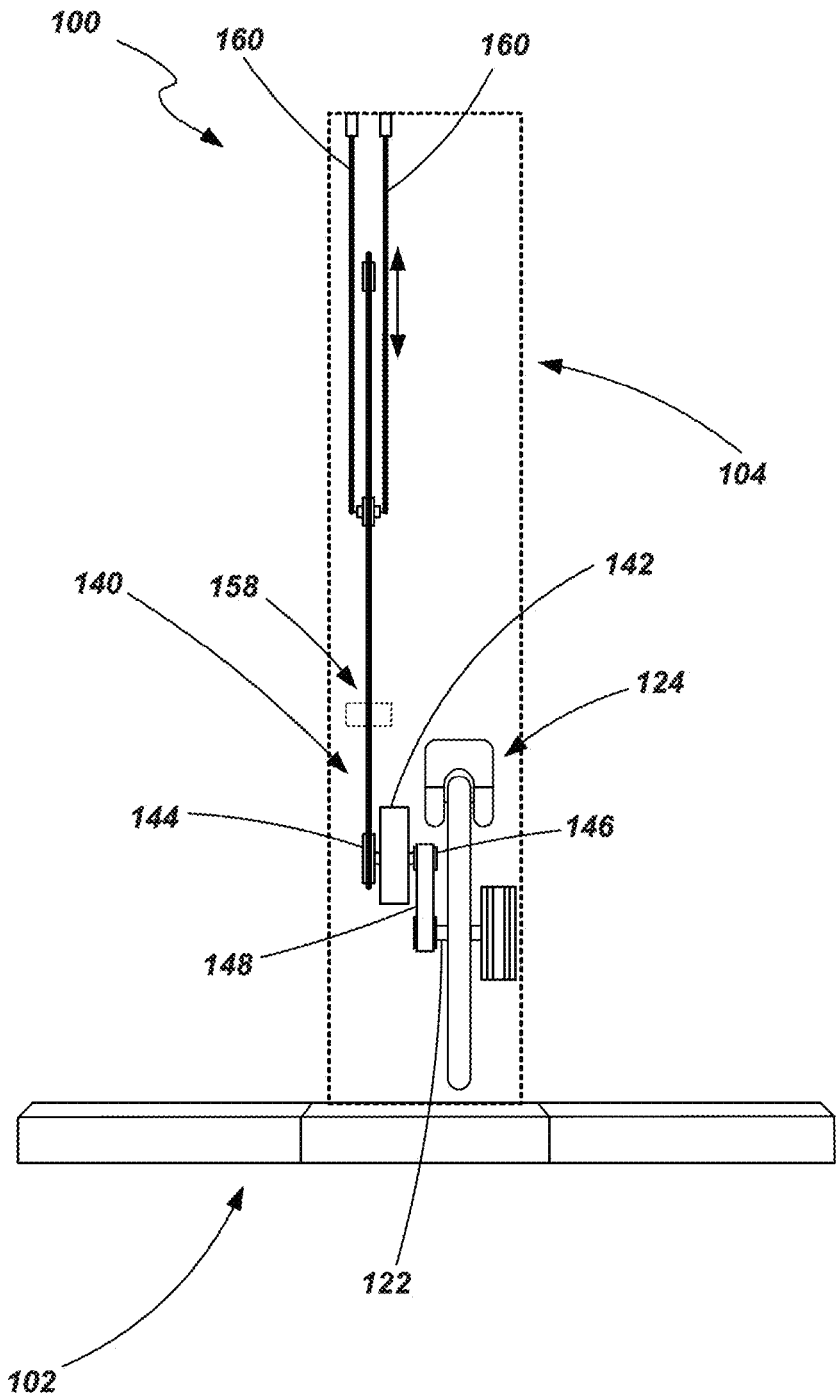

Referring briefly to FIGS. 5A and 5B, views similar to those depicted in FIGS. 4A and 4B, respectively, show certain components in a second position or state. Specifically, FIG. 5A depicts the displacement of a handle 118A due to application of a force by an individual during exercise. Displacement of the handle 118A results in displacement of the associated cable 116A and, ultimately, displacement of the drive chain 150. As indicated in FIG. 5A, a first portion of the drive chain 150 is displaced upwards towards the first sprocket 154 as indicated by directional arrow 170 while a second portion of the drive chain 150 is displaced downwards away from the second sprocket 156 and towards the input shaft 144 as indicated by directional arrow 172. It is noted that this displacement of the drive chain 150 also includes the downward displacement of the second sprocket 156 against the force of the biasing members 160 as seen in both FIGS. 5A and 5B. The displacement of the drive chain 150 results in the rotation of the input shaft 144, actuating the drive mechanism 140 such that the drive belt 148 drives the flywheel 120.

Upon release of the force applied to the handle 118A, the biasing members 160 pull the second sprocket 156 back to its previous position bringing the various components (e.g., drive chain 150, cable 116A and handle 118A) back to the positions shown in FIGS. 4A and 4B. However, as noted above, the return of the drive chain 150 to its previous position does not cause the flywheel 120 to rotate in the opposite direction or otherwise hinder its continued rotation due to the directional preference of the clutch mechanism 142. It is noted that, while the example shown in FIGS. 5A and 5B is described in terms of one particular handle (i.e., 118A) being displaced, the same functionality applies to the displacement to the other handle (i.e., 118B) or to both of them being substantially simultaneously displaced.

INDUSTRIAL APPLICABILITY

During exercise, many individuals desire to focus on anaerobic strength training, or to integrate anaerobic strength training with aerobic work-outs. One of the difficulties in mixing both aerobic and anaerobic activities is the ability of an individual to efficiently and effectively track their progress. For example, many individuals use aerobic exercise equipment such as a treadmill, an elliptical machine or a pedometer to help track the calories that they've burned while using such equipment. However, it is more difficult to track or calculate such information when doing strength training types of exercises.

The exercise apparatus provided herein provides a strength training apparatus that enables a variety of exercises while also providing the ability to track the work performed by an individual during their exercise session. By positioning the adjustable arms at different locations relative to the tower, different types of exercises may be conducted. For example, due to the adjustability of the arms/pulleys, the exercise apparatus may be used to perform exercises including, but not limited to, standing abdominal crunches, curls and other bicep exercises, lat pull-downs, chest presses, incline and decline presses, overhead presses, triceps extensions, shoulder extensions, leg extensions, leg curls, abduction and adduction exercises, and a variety of other exercises, including variations of the examples provided.

Additionally, the use of a flywheel in connection with a strength training apparatus provides a different form of resistance than in conventional strength training exercises, one that can be measured, tracked and incorporated into a planned exercise routine. The flywheel, combined with a braking mechanism such as a magnetic brake, enables considerable flexibility in setting the desired resistance during exercise. In many conventional strength training exercises, the amount of resistance provided (e.g., by free weights, weight stacks or resistance bands) is only adjustable in set increments (e.g., 5 or 10 pound increments). The use of a flywheel with a variable resistance braking mechanism enables fine tuning of the resistance over a continuous spectrum between two defined limits.

The use of a torque sensor in conjunction with the flywheel enables the calculation of work, power or energy so that, for example, a user of the apparatus may determine their performance level while using the exercise apparatus. In one particular example, the power expended during an exercise session may be expressed in watts (i.e., joules/sec (J/s) or newton meters I sec (N*m/s). A user of the machine can review the power expended during an exercise session from a display (or other output device) associated with the exercise apparatus and then compare their performance to a goal or a benchmark.

Such a way of tracking the effort expended during an anaerobic exercise routine provides more insight into the progress of the individual than just the number of repetitions completed during a given work-out session. If desired, other units may be utilized to track the energy expended by an individual during a work-out session. For example, rather than expressing the work-out performance in terms of watts (units of power), it could be expressed in terms of joules (units of work).

This information could be used with information from other work-out activities, including aerobic exercise, to consistently monitor the performance of an individual over a desired period of time. For example, rather than expressing the performance of an individual on a treadmill or an elliptical machine in terms of calories, those performances may similarly be provided in terms of watts (or another selected unit) so that all types of exercise activity may be monitored uniformly. An individual may then customize their exercise routine based, for example, on the amount of work that is to be performed regardless of whether that work occurs during an aerobic or an anaerobic activity.

One example of customizing a work-out that may be utilized in conjunction with the exercise apparatus described herein is set forth in U.S. patent application Ser. No. 13/754,361, filed on Jan. 30, 2013, which published on Aug. 1, 2013 as U.S. Patent Application Publication No. 2013/0196821 A1 ("the '821 Publication"), the disclosure of which is incorporated by reference herein in its entirety. One particular example of tracking a work-out across various exercise equipment and which may be utilized in conjunction with the exercise apparatus described herein is set forth in U.S. Pat. No. 6,746,371 to Brown et al., the disclosure of which is incorporated by reference herein in its entirety.

For example, FIG. 1 of the '821 Publication illustrates a block diagram of one embodiment of an environment 100 in which the present systems and methods may be implemented. In one configuration, an exercise apparatus 102 may exchange information with a client computing device 106. The client computing device 106 may acquire the information from the apparatus 102. For example, the information may be embedded as a data exchanging module 104 that is included on or by the exercise apparatus 102. Examples of the data exchanging module 104 may include, but are not limited to, barcodes, QR codes, RF tags, etc. The module 104 may be affixed or attached to an area of the apparatus 102 or an area that is not on the apparatus 102 (e.g., a wall close to the apparatus 102). The client computing device 106 may include a data sensing module 108 that is able to sense the data exchanging module 104. For example, the sensing module 108 may provide scanning capabilities that allows the device 106 to scan the data exchanging module 104 to obtain information about the apparatus 102. For example, the data exchanging module 104 may be a barcode and the data sensing module 108 may be a barcode scanner. In another embodiment, the data exchanging module 104 and the data sensing module 108 may include near field communication (NFC) capabilities. As a result, using NFC standards, a radio communication link may be established between the apparatus 102 and the device 106. The client computing device 106 may acquire the information from the exercise apparatus 102 via the radio communication link. The apparatus 102 and the device 106 may exchange information via other methods in addition to bar codes, QR codes, and NFC technologies.

Examples of the exercise apparatus 102 may include a weight machine (e.g., a fly machine, a leg press machine, a leg curl machine, a leg extension machine, a cable lateral pull-down machine, a triceps pull-down machine, a row machine, etc.). The exercise apparatus 102 may also be a free weight, such as a dumbbell, a medicine ball, an exercise ball, a bench press, etc. In another embodiment, the exercise apparatus 102 may be a cardio machine (e.g., a treadmill, a stationary bike, a spinner bike, a stair machine, etc.).

In one embodiment, the client computing device 106 may be a smartphone, a laptop, a tablet, or any other portable computing device. In one configuration, the client computing device 106 may be any device that is able to detect, receive, and interpret the data acquired from the data exchanging module 104. To interpret the received data, the client computing device 106 may communicate with a server 112 across a network 110 connection. The network 110 connection may be a Wi-Fi, a wireless local area network (WLAN), a cellular network, and the like. The server 112 may communicate with an exercise apparatus database 114. The database 114 may be external to the server 112, or the database 114 may be built into the server 112. In one embodiment, the exercise apparatus database 114 may store information regarding the exercise apparatus 102. For example, the database 114 may store instructions that indicate how to properly use the exercise apparatus 102. The database 114 may also store videos that demonstrate how to use the apparatus 102. In one example, the client computing device 106 may acquire information from the apparatus, such as an identifier that identifies the apparatus 102. The identifier may be communicated to the server 112. The server 112 may use the identifier to locate additional information in the database 114 about the apparatus 102. The server may communicate the additional information about the apparatus 102 to the computing device 106. In one embodiment, the data exchanging module 104 may include the additional information that is stored in the database 114. As a result, when the computing device 106 acquires the information from the apparatus 102, there may be no need for the client 106 to communicate with the server 112 to acquire the additional information.

FIG. 2 of the '821 Publication is a block diagram illustrating one embodiment of a client computing device 106-a. The client computing device 106-a may be an example of the client computing device 106 illustrated in FIG. 1 of the '821 Publication. In one example, the client computing device 106-a may include a data sensing module 108-a. In one configuration, the module 108-a may include a QR code module 202, a barcode reading module 204, an NFC module 206, a profile module 208, a customized workout module 210, and a tracking module 212. Details regarding each of these modules will be described below.

In one embodiment, the QR code module 202 may sense data affixed to or by the exercise apparatus 102 that is encoded as a QR code. Similarly, the barcode reading module 204 may sense data embedded or encoded as a barcode that may be attached to or near the exercise apparatus 102. The modules 202 and 204 may sense the data by scanning the QR code or the barcode that is attached to the exercise apparatus 102. The NFC module 206 may establish a radio communication link with the exercise apparatus 102. The NFC module 206 may acquire data from the exercise apparatus 102 via the radio communication link.

In one configuration, the profile module 208 may receive and store input from a user relating to the user's profile information. Examples of profile information may include the user's age, height, weight, etc. The profile module 208 may further receive and store input from the user relating to physical fitness goals of the user. Examples of physical fitness goals may include a desired weight loss, strength conditioning goals, target heart rate goals, running/walking distance goals, specific muscle definition goals etc. The customized workout module 210 may receive the data sensed from the modules, 202, 204, and/or 206. The workout module 210 may also receive information stored by the profile module 208. In one embodiment, the workout module 210 may generate a customized workout routine for the user to perform with the exercise apparatus 102 in order to progress towards achieving the physical fitness goals stored in the profile module.

As an example, the client computing device 106-a may receive data relating to the exercise apparatus 102. The data may indicate the name of the apparatus 102, the functions of the exercise apparatus 102, instructions on how to properly use the exercise apparatus 102, the muscle group focused on by the exercise apparatus 102, the health benefits of using the apparatus 102, video or other multimedia data that demonstrate how to use the apparatus 102, etc. The data may be received directly from the data exchange module 104 affixed to the apparatus 102 and/or from the server 112 that obtains the data from the database 114 and communicates the data to the client computing device 106. The customized workout module 210 may analyze the received data about the exercise apparatus 102 together with the information stored by the profile module 208. Based on this analysis, the customized workout module 210 may generate a workout routine for the user to perform with the exercise apparatus 102. The generated workout routine may be focused on helping the user accomplish one or more physical fitness goals stored by the profile module 208. For example, the user may specify a physical fitness goal of bench pressing 200 lbs. The profile module 208 may also include information that indicates that the user is currently able to bench 160 lbs. The user may then approach a chest fly machine with the client computing device 106-a. A barcode may be affixed on a portion of the machine. The computing device 106-a may scan the barcode and obtain data about the machine. As stated above, the data may be acquired from the scan of the barcode and/or from the server 112. For example, the client 106-a may scan the barcode and retrieve the identity of the machine (in this example, a chest fly machine). The identity may be transmitted to the server 112. The server 112 may use the received identity to search the database 114 for data about the machine. The server 112 may then communicate the data back to the client computing device 106-a.

The data (either obtained directly from the exercise apparatus 102 and/or from the server 112) may indicate that the chest fly machine focuses on certain chest muscles. The data may also include a video demonstration that illustrates how to properly use the chest fly machine. The customized workout module 210 may generate a workout routine (e.g., number of repetitions, sets, and the weight resistance) for the user to follow when using the chest fly machine. The routine may be generated based on an analysis of the information stored by the profile module 208 as well as the data acquired from the exercise apparatus (directly and/or indirectly from the server 112). The workout routine may be customized for the user to assist the user to accomplish the physical fitness goal(s) included in the profile module. As a result, the workout routine, if followed by the user, may assist the user to accomplish the goal of bench pressing 200 lbs.

In one example, the profile module 208 may not include physical fitness goal information that relates to a certain exercise apparatus 102. For instance, the sensing module 108-a may acquire information relating to a treadmill by scanning a barcode, QR code, etc. The customized workout module 210 may analyze the profile module 208 and discover that the user has not entered a goal that may be accomplished by using the treadmill. In one configuration, the customized module 210 may query the user as to whether the user would like to enter a physical fitness goal that may be achieved by using the treadmill. For example, the module 210 may display the following query "Do you want to set a goal to run 3 miles in 30 minutes?" If the user selects this goal, the workout module 210 may continue to generate a customized workout routine for the user to assist the user to complete this goal. Instead of selecting a goal generated by the customized workout module 210, the user may provide his/her own goal as it relates to the treadmill. Once the goal is provided, the module 210 may generate a customized workout routine.

The tracking module 212 may track the progress of the user while the user is using the exercise apparatus 102. For example, the tracking module 212 may be a camera or other tracking device that is capable of monitoring the movement of the user. The tracking module 212 may also track the progress of the user towards completing the goals specified in the profile module 208. For example, the profile module 208 may include a goal to lose 20 lbs. The tracking module 212 may track the weight of the user to allow the user to see his/her progress towards achieving the goal of losing 20 pounds. In one example, the user may manually enter his/her weight into the tracking module 212. In another embodiment, the tracking module 212 may track the progress of the user by receiving automatic updates via email, SMS messages, and the like that include the current state of the user. For example, the user may visit a website and record his/her weight on the website. The website may communicate with the tracking module 212 to provide the updated weight of the user.

FIG. 3 of the '821 Publication is a block diagram illustrating one embodiment of a profile module 208-a. The profile module 208-a may be an example of the profile module 208 illustrated in FIG. 2 of the '821 Publication. In one configuration, the profile module 208-a may include a personal information module 302 and a goal information module 304.

In one embodiment, the personal information module 302 may include personal information about the user, such as, but not limited to, the user's age, height, weight, resting heart rate, and any other biometric information. The goal information module 304 may include physical fitness goals provided by the user. For example, the goal information module 304 may store a weight loss goal, a strength conditioning goal, a cardio goal, and the like. In one example, the user may manually input information to the modules 302, 304 via interfaces provided by the client computing device 106. In another embodiment, the user may provide the information to the modules 302, 304 remotely by interfacing with a website and inputting the information. The information may then be transmitted from the website to the client computing device 106 and stored as part of the modules 302, 304.

FIG. 4 of the '821 Publication is a block diagram illustrating one embodiment of a customized workout module 210-a. The module 210-a may be an example of the customized workout module 210 of FIG. 2 of the '821 Publication. In one embodiment, the module 210-a may include a profile analysis module 402, an exercise apparatus analysis module 404, a workout generation module 406, and a demonstration generation module 408.

In one configuration, the profile analysis module 402 may analyze information provided by the profile module 208. The information provided by the profile module 208 may include the physical fitness goals entered by the user. The workout generation module 404 may generate a customized workout routine for the user with relation to the exercise apparatus 102. For example, the exercise apparatus 102 may be a dumbbell. The profile analysis module 402 may determine that the user has set a goal to be able to do 10 repetitions of a bicep curl using a 50 pound dumbbell. The profile analysis module 402 may further determine from the information provided by the profile module 208 that the user has previously performed curls using 25 lb dumbbells. The exercise apparatus analysis module 404 may analyze data about the apparatus. The data may be received by scanning a barcode, QR code, etc. that may be affixed to the apparatus. The profile analysis module 402 may determine from the specific muscles focused on by the exercise apparatus.

The workout generation module 406 may generate a schedule of workouts for dumbbells of various weights that will gradually build up the user's bicep muscles to eventually reach the user's goal of performing 10 repetitions of a bicep curl using a 50 lb dumbbell. For example, the generation module 406 may suggest the user begin by performing 3 sets of 10 repetitions using 25 lb dumbbells. The generated workout may instruct the user to perform this workout four times a week. The generation module 406 may generate a workout that specifies that each week the weight of the dumbbell should be increased by 5 lbs. As a result, based on the goals provided by the user, the generation module 404 may generate a customized workout for a particular exercise apparatus 102 to assist the user to achieve his/her goals.

The demonstration generation module 408 may generate and/or provide a demonstration of how to use the exercise apparatus 102. For example, the generation module 408 may generate and/or provide a video that the user may view on the client computing device 106 to learn how to properly use the exercise apparatus 102. The demonstration generation module 408 may also generate and/or provide a text document that the user may read that includes instructions on how to use the exercise apparatus 102.

FIG. 5 of the '821 Publication is a block diagram illustrating one embodiment of an exercise apparatus 102-a and a tracking module 212-a. In one example, the exercise apparatus 102-a may be an example of the exercise apparatus 102 illustrated in FIG. 1 of the '821 Publication. The tracking module 212-a may be an example of the tracking module 212 illustrated in FIG. 2 of the '821 Publication.

In one embodiment, the exercise apparatus 102-a may include a monitoring apparatus 502-a-1. The monitoring apparatus 502-a-1 may monitor the user while the user is using the exercising apparatus 102-a. For example, the monitoring apparatus 502-a-1 may be a camera installed or connected to the exercise apparatus 102-a. The apparatus 502-a-1 may also be a magnetic strip attached to the exercise apparatus 102-a that detects movement of the apparatus 102 (e.g., a dumbbell). The monitoring apparatus 502-a-1 may record the actions of the user while the user is performing exercises using the exercising apparatus 102-a. The recorded actions may be transmitted to the tracking module 212-a.

The tracking module 212-a may also include a monitoring apparatus 502-a-2 to record the actions of the user while the user is engaged with a particular exercise apparatus. The apparatus 502-a-2 may be a camera, or other tracking device to record the activity of the user. The tracking module 212-a may further include a workout history module 504 and a goal monitoring module 506. The workout history module 504 may store information regarding past workouts performed by the user. For example, the monitoring apparatuses 502-a-1 and/or 502-a-2 may monitor a user running on a treadmill for 30 minutes. At the conclusion of the 30 minutes, the monitoring apparatus 502 may communicate the information to the workout history module 504. If the user is using a weight machine, the monitoring apparatus 502 may detect the number of repetitions as well as the weight used during the repetitions. As a result, the workout history module 504 may include a log that documents the past workout activity of the user with various exercise machines.

In one embodiment, the goal monitoring module 506 may monitor the goals specified by the user. The module 506 may track the progress of the user with respect to achieving the goals. For example, the goal monitoring module 506 may communicate with the workout history module 504 to determine whether the user has satisfied a particular goal. The monitoring module 506 may generate a transmit goal update message to the user (e.g., via email, SMS text, etc.) that indicate to the user the user's progress in completing a goal. The module 506 may also send a goal completed message to the user when it is determined that a physical fitness goal has been accomplished.

FIG. 9 of the '821 Publication depicts a block diagram of a computer system 910 suitable for implementing the present systems and methods. The computer system 910 may be an example of the client computing device 106 of FIG. 1 of the '821 Publication. Computer system 910 includes a bus 912 which interconnects major subsystems of computer system 910, such as a central processor 914, a system memory 917 (typically RAM, but which may also include ROM, flash RAM, or the like), an input/output controller 918, an external audio device, such as a speaker system 920 via an audio output interface 922, an external device, such as a display screen 924 via display adapter 926, serial ports 928 and 930, a keyboard 932 (interfaced with a keyboard controller 933), multiple USB devices 992 (interfaced with a USB controller 991), a storage interface 934, a floppy disk unit 937 operative to receive a floppy disk 938, a host bus adapter (HBA) interface card 935A operative to connect with a Fibre Channel network 990, a host bus adapter (HBA) interface card 935B operative to connect to a SCSI bus 939, and an optical disk drive 940 operative to receive an optical disk 942. Also included are a mouse 946 (or other point-and-click device, coupled to bus 912 via serial port 928), a modem 947 (coupled to bus 912 via serial port 930), and a network interface 948 (coupled directly to bus 912).

Bus 912 allows data communication between central processor 914 and system memory 917, which may include read-only memory (ROM) or flash memory (neither shown), and random access memory (RAM) (not shown), as previously noted. The RAM is generally the main memory into which the operating system and application programs are loaded. The ROM or flash memory can contain, among other code, the Basic Input-Output system (BIOS) which controls basic hardware operation such as the interaction with peripheral components or devices. For example, the data sensing module 108-b to implement the present systems and methods may be stored within the system memory 917. Applications resident with computer system 910 are generally stored on and accessed via a non-transitory computer readable medium, such as a hard disk drive (e.g., fixed disk 944), an optical drive (e.g., optical drive 940), a floppy disk unit 937, or other storage medium. Additionally, applications can be in the form of electronic signals modulated in accordance with the application and data communication technology when accessed via network modem 947 or interface 948.

In one configuration, when the portable device retrieves information about an exercise machine, the portable device may also access physical fitness goals for the user. The user may have previously entered the goals or, upon retrieving information about an exercise machine, the portable device may query the user to select or enter physical fitness goals. Upon accessing the goals, the information about the exercise machine may be analyzed to determine whether the exercise machine may assist the user to accomplish one or more of the goals. If the machine cannot help the user accomplish the provided goals, the user may be queried as to whether he/she would like to select (or provide) a goal that this particular exercise machine may help the user accomplish. If the machine is able to assist the user in completing a goal, a customized workout routine may be generated and displayed to the user. The workout routine may provide instructions to the user relating to the number of repetitions, sets, the amount of weight, the amount of time, speed, incline, resistance, etc., that the user should perform to accomplish a goal using the exercise machine.

The invention claimed is:

1. A strength training apparatus comprising:

a first arm and a second arm each being configured to be selectively pivoted independent of each other at multiple angles relative to each other;

a first pulley coupled to an end of the first arm;

a first cable extending through the first arm and the first pulley;

a second pulley coupled to an end of the second arm;

a second cable extending through the second arm and the second pulley; and an electronic control panel configured to allow for multiple levels of resistance to a user pulling on the first cable and/or the second cable, the electronic control panel including:

a processor and a memory configured to control a current level of resistance, an electronic input device configured to allow the user to set the current level of resistance, and an electronic output device configured to display the current level of resistance.

2. The strength training apparatus of claim 1, further comprising:

a first handle coupled to the first cable; and a second handle coupled to the second cable.

3. The strength training apparatus of claim 1, wherein:

the processor and the memory are further configured to calculate an amount of power expended within a period of time by the user pulling on the first cable and/or the second cable; and the electronic output device is further configured to display the calculated amount of power.

4. The strength training apparatus of claim 1, wherein the processor and the memory are further configured to receive and store a physical fitness goal that is inputted by the user.

5. The strength training apparatus of claim 4, wherein the processor and the memory are further configured to provide a customized workout routine for the strength training apparatus based on the stored physical fitness goal.

6. The strength training apparatus of claim 4, wherein the processor and the memory are further configured to generate a schedule of upcoming customized workout routines for the strength training apparatus based on the stored physical fitness goal.

7. The strength training apparatus of claim 4, wherein the processor and the memory are further configured to track progress of the user toward completing the stored physical fitness goal.

8. The strength training apparatus of claim 4, wherein the processor and the memory are further configured to display on the electronic output device a progress of the user toward completing the stored physical fitness goal.

9. The strength training apparatus of claim 4, wherein the processor and the memory are further configured to display on the electronic output device that the user has achieved the stored physical fitness goal when it is determined that the stored physical fitness goal has been achieved.

10. The strength training apparatus of claim 4, wherein the processor and the memory are further configured to display videos on the electronic output device that demonstrate how to use the strength training apparatus.

11. The strength training apparatus of claim 1, wherein the processor and the memory are further configured to store information regarding past workout routines performed by the user on the strength training apparatus.

12. The strength training apparatus of claim 11, wherein:
the stored information regarding the past workout routines includes a most recent level of resistance; and
the processor and the memory are further configured to suggest that the user begin an upcoming workout routine at the stored most recent level of resistance.

13. The strength training apparatus of claim 1, wherein the processor and the memory are further configured to track an amount of time that the user used the strength training apparatus.

14. The strength training apparatus of claim 1, wherein the processor and the memory are further configured to receive from the user, and store, an age of the user, a height of the user, and a weight of the user.

15. The strength training apparatus of claim 1, wherein the electronic control panel further includes a connection for communication with another device.

16. The strength training apparatus of claim 15, wherein the connection includes a radio communication link.

17. The strength training apparatus of claim 15, further comprising an application program configured to be loaded on the other device.

18. The strength training apparatus of claim 17, wherein the application program is configured to:
display information regarding past workout routines performed by the user on the strength training apparatus;
display a schedule of customized workout routines for the strength training apparatus based on a stored physical fitness goal that was inputted by the user; and
generate a custom workout routine for the strength training apparatus that includes sets and repetitions of an exercise that involves pulling on the first cable and/or the second cable.

19. The strength training apparatus of claim 1, wherein:
the strength training apparatus further comprises a magnetic mechanism coupled to the first cable and the second cable and configured to provide the multiple levels of resistance to the user pulling on the first cable and/or the second cable;
the processor and the memory are further configured to control the current level of resistance provided by the magnetic mechanism;
the electronic input device is further configured to allow the user to set the current level of resistance provided by the magnetic mechanism; and
the electronic output device is further configured to display the current level of resistance provided by the magnetic mechanism.

20. The strength training apparatus of claim 1, wherein:
the strength training apparatus further comprises a magnetic unit and a flywheel coupled to the first cable and the second cable and configured to provide the multiple levels of resistance to the user pulling on the first cable and/or the second cable;
the processor and the memory are further configured to control the current level of resistance provided by the magnetic unit and the flywheel;
the electronic input device is further configured to allow the user to set the current level of resistance provided by the magnetic unit and the flywheel; and
the electronic output device is further configured to display the current level of resistance provided by the magnetic unit and the flywheel.

21. The strength training apparatus of claim 1, wherein:
the strength training apparatus further comprises an upright support structure; and
the first arm and the second arm are each pivotally coupled to the upright support structure.

22. The strength training apparatus of claim 21, wherein:
the strength training apparatus further comprises a base member; and
the upright support structure is coupled to, and extends upward from, the base member.

23. The strength training apparatus of claim 1, wherein the processor and the memory are further configured to:
receive and store a physical fitness goal that is inputted by the user;
provide a customized workout routine for the strength training apparatus based on the stored physical fitness goal;
generate a schedule of upcoming customized workout routines for the strength training apparatus based on the stored physical fitness goal;
display on the electronic output device a progress of the user toward completing the stored physical fitness goal;
track progress of the user toward completing the stored physical fitness goal;
display on the electronic output device that the user has achieved the stored physical fitness goal when it is determined that the stored physical fitness goal has been achieved;
display videos on the electronic output device that demonstrate how to use the strength training apparatus;
store information regarding past workout routines performed by the user on the strength training apparatus, the stored information regarding the past workout routines including a most recent level of resistance;
suggest that the user begin an upcoming workout routine at the stored most recent level of resistance;

track an amount of time that the user used the strength training apparatus; and receive from the user, and store, an age of the user, a height of the user, and a weight of the user.

24. The strength training apparatus of claim 1, wherein:

the electronic control panel further includes a radio communication link for communication with another device; and the strength training apparatus further comprises an application program configured to be loaded on the other device, the application program configured to:

display information regarding past workout routines performed by the user on the strength training apparatus, display a schedule of customized workout routines for the strength training apparatus based on a stored physical fitness goal that was inputted by the user, and generate a custom workout routine for the strength training apparatus that includes sets and repetitions of an exercise that involves pulling on the first cable and/or the second cable.

25. A strength training apparatus comprising:

a first arm and a second arm each being configured to be selectively pivoted independent of each other to be selectively positioned at multiple angles relative to each other;

a first pulley coupled to an end of the first arm;

a first cable extending through the first arm and the first pulley;

a second pulley coupled to an end of the second arm;

a second cable extending through the second arm and the second pulley; and an electronic control panel configured to allow for multiple levels of resistance to a user pulling on the first cable and/or the second cable, the electronic control panel including:

a processor and a memory configured to control a current level of resistance, the processor and the memory further configured to calculate an amount of power expended within a period of time by the user pulling on the first cable and/or the second cable, an electronic input device configured to allow the user to set the current level of resistance, and an electronic output device configured to display the current level of resistance, the electronic output device further configured to display the calculated amount of power.

26. The strength training apparatus of claim 25, further comprising:

a first handle coupled to the first cable; and a second handle coupled to the second cable.

27. The strength training apparatus of claim 25, wherein the processor and the memory are further configured to receive and store a physical fitness goal that is inputted by the user via the electronic input device.

28. The strength training apparatus of claim 27, wherein the processor and the memory are further configured to provide a customized workout routine for the strength training apparatus based on the stored physical fitness goal.

29. The strength training apparatus of claim 27, wherein the processor and the memory are further configured to generate a schedule of upcoming customized workout routines for the strength training apparatus based on the stored physical fitness goal.

30. The strength training apparatus of claim 27, wherein the processor and the memory are further configured to track progress of the user toward completing the stored physical fitness goal.

31. The strength training apparatus of claim 27, wherein the processor and the memory are further configured to display on the electronic output device a progress of the user toward completing the stored physical fitness goal.

32. The strength training apparatus of claim 27, wherein the processor and the memory are further configured to display on the electronic output device that the user has achieved the stored physical fitness goal when it is determined that the stored physical fitness goal has been achieved.

33. The strength training apparatus of claim 27, wherein the processor and the memory are further configured to display videos on the electronic output device that demonstrate how to use the strength training apparatus.

34. The strength training apparatus of claim 25, wherein the processor and the memory are further configured to store information regarding past workout routines performed by the user on the strength training apparatus.

35. The strength training apparatus of claim 34, wherein:

the stored information regarding the past workout routines includes a most recent level of resistance; and the processor and the memory are further configured to suggest that the user begin an upcoming workout routine at the stored most recent level of resistance.

36. The strength training apparatus of claim 25, wherein the processor and the memory are further configured to track an amount of time that the user used the strength training apparatus.

37. The strength training apparatus of claim 25, wherein the processor and the memory are further configured to receive from the user, and store, an age of the user, a height of the user, and a weight of the user.

38. The strength training apparatus of claim 25, wherein the electronic control panel further includes a connection for communication with another device.

39. The strength training apparatus of claim 38, wherein the connection includes a radio communication link.

40. The strength training apparatus of claim 38, further comprising an application program configured to be loaded on the other device.

41. The strength training apparatus of claim 40, wherein the application program is configured to:

display information regarding past workout routines performed by the user on the strength training apparatus;

display a schedule of customized workout routines for the strength training apparatus based on a stored physical fitness goal that was inputted by the user; and generate a custom workout routine for the strength training apparatus that includes sets and repetitions of an exercise that involves pulling on the first cable and/or the second cable.

42. The strength training apparatus of claim 25, wherein:

the strength training apparatus further comprises a magnetic mechanism coupled to the first cable and the second cable and configured to provide the multiple levels of resistance to the user pulling on the first cable and/or the second cable;

the processor and the memory are further configured to control the current level of resistance provided by the magnetic mechanism;

the electronic input device is further configured to allow the user to set the current level of resistance provided by the magnetic mechanism; and the electronic output device is further configured to display the current level of resistance provided by the magnetic mechanism.

43. The strength training apparatus of claim 25, wherein:

the strength training apparatus further comprises a magnetic unit and a flywheel coupled to the first cable and the second cable and configured to provide the multiple levels of resistance to the user pulling on the first cable and/or the second cable;

the processor and the memory are further configured to control the current level of resistance provided by the magnetic unit and the flywheel;

the electronic input device is further configured to allow the user to set the current level of resistance provided by the magnetic unit and the flywheel; and the electronic output device is further configured to display the current level of resistance provided by the magnetic unit and the flywheel.

44. The strength training apparatus of claim 25, wherein:

the strength training apparatus further comprises an upright support structure; and the first arm and the second arm are each pivotally coupled to the upright support structure.

45. The strength training apparatus of claim 44, wherein:

the strength training apparatus further comprises a base member; and the upright support structure is coupled to, and extends upward from, the base member.

46. The strength training apparatus of claim 25, wherein the processor and the memory are further configured to:

receive and store a physical fitness goal that is inputted by the user;

provide a customized workout routine for the strength training apparatus based on the stored physical fitness goal;

generate a schedule of upcoming customized workout routines for the strength training apparatus based on the stored physical fitness goal;

display on the electronic output device a progress of the user toward completing the stored physical fitness goal;

track progress of the user toward completing the stored physical fitness goal;

display on the electronic output device that the user has achieved the stored physical fitness goal when it is determined that the stored physical fitness goal has been achieved;

display videos on the electronic output device that demonstrate how to use the strength training apparatus;

store information regarding past workout routines performed by the user on the strength training apparatus, the stored information regarding the past workout routines including a most recent level of resistance;

suggest that the user begin an upcoming workout routine at the stored most recent level of resistance;

track an amount of time that the user used the strength training apparatus; and receive from the user, and store, an age of the user, a height of the user, and a weight of the user.

47. The strength training apparatus of claim 25, wherein:

the electronic control panel further includes a radio communication link for communication with another device;

the strength training apparatus further comprises an application program configured to be loaded on the other device, the application program configured to:

display information regarding past workout routines performed by the user on the strength training apparatus;

display a schedule of customized workout routines for the strength training apparatus based on a stored physical fitness goal that was inputted by the user; and generate a custom workout routine for the strength training apparatus that includes sets and repetitions of an exercise that involves pulling on the first cable and/or the second cable.

48. A strength training apparatus comprising:

a first arm and a second arm each being configured to be selectively pivoted independent of each other to be selectively positioned at multiple angles relative to each other;

a first pulley coupled to an end of the first arm;

a first cable extending through the first arm and the first pulley;

a second pulley coupled to an end of the second arm;

a second cable extending through the second arm and the second pulley; and an electronic control panel configured to allow for multiple levels of resistance to a user pulling on the first cable and/or the second cable, the electronic control panel including:

a processor and a memory configured to control a current level of resistance, the processor and the memory further configured to receive and store a physical fitness goal that is inputted by the user, the processor and the memory further configured to provide a customized workout routine for the strength training apparatus based on the stored physical fitness goal, an electronic input device configured to allow the user to set the current level of resistance, and an electronic output device configured to display the current level of resistance.

49. The strength training apparatus of claim 48, further comprising:

a first handle coupled to the first cable; and a second handle coupled to the second cable.

50. The strength training apparatus of claim 48, wherein:

the processor and the memory are further configured to calculate an amount of power expended within a period of time by the user pulling on the first cable and/or the second cable; and the electronic output device is further configured to display the calculated amount of power.

51. The strength training apparatus of claim 48, wherein the processor and the memory are further configured to generate a schedule of upcoming customized workout routines for the strength training apparatus based on the stored physical fitness goal.

52. The strength training apparatus of claim 48, wherein the processor and the memory are further configured to track progress of the user toward completing the stored physical fitness goal.

53. The strength training apparatus of claim 48, wherein the processor and the memory are further configured to display on the electronic output device a progress of the user toward completing the stored physical fitness goal.

54. The strength training apparatus of claim 48, wherein the processor and the memory are further configured to display on the electronic output device that the user has achieved the stored physical fitness goal when it is determined that the stored physical fitness goal has been achieved.

55. The strength training apparatus of claim 48, wherein the processor and the memory are further configured to display videos on the electronic output device that demonstrate how to use the strength training apparatus.

56. The strength training apparatus of claim 48, wherein the processor and the memory are further configured to store information regarding past workout routines performed by the user on the strength training apparatus.

57. The strength training apparatus of claim 56, wherein:

the stored information regarding the past workout routines includes a most recent level of resistance; and the processor and the memory are further configured to suggest that the user begin an upcoming workout routine at the stored most recent level of resistance.

58. The strength training apparatus of claim 48, wherein the processor and the memory are further configured to track an amount of time that the user used the strength training apparatus.

59. The strength training apparatus of claim 48, wherein the processor and the memory are further configured to receive from the user, and store, an age of the user, a height of the user, and a weight of the user.

60. The strength training apparatus of claim 48, wherein the electronic control panel further includes a connection for communication with another device.

61. The strength training apparatus of claim 60, wherein the connection includes a radio communication link.

62. The strength training apparatus of claim 60, further comprising an application program configured to be loaded on the other device.

63. The strength training apparatus of claim 48, wherein:

the strength training apparatus further comprises a magnetic mechanism coupled to the first cable and the second cable and configured to provide the multiple levels of resistance to the user pulling on the first cable and/or the second cable;

the processor and the memory are further configured to control the current level of resistance provided by the magnetic mechanism;

the electronic input device is further configured to allow the user to set the current level of resistance provided by the magnetic mechanism; and the electronic output device is further configured to display the current level of resistance provided by the magnetic mechanism.

64. The strength training apparatus of claim 48, wherein:

the strength training apparatus further comprises a magnetic unit and a flywheel coupled to the first cable and the second cable and configured to provide the multiple levels of resistance to the user pulling on the first cable and/or the second cable;

the processor and the memory are further configured to control the current level of resistance provided by the magnetic unit and the flywheel;

the electronic input device is further configured to allow the user to set the current level of resistance provided by the magnetic unit and the flywheel; and the electronic output device is further configured to display the current level of resistance provided by the magnetic unit and the flywheel.

65. The strength training apparatus of claim 48, wherein:

the strength training apparatus further comprises an upright support structure; and the first arm and the second arm are each pivotally coupled to the upright support structure.

66. The strength training apparatus of claim 65, wherein:

the strength training apparatus further comprises a base member; and the upright support structure is coupled to, and extends upward from, the base member.

67. The strength training apparatus of claim 48, wherein the processor and the memory are further configured to:

generate a schedule of upcoming customized workout routines for the strength training apparatus based on the stored physical fitness goal;

display on the electronic output device a progress of the user toward completing the stored physical fitness goal;

track progress of the user toward completing the stored physical fitness goal;

display on the electronic output device that the user has achieved the stored physical fitness goal when it is determined that the stored physical fitness goal has been achieved;

display videos on the electronic output device that demonstrate how to use the strength training apparatus;

store information regarding past workout routines performed by the user on the strength training apparatus, the stored information regarding the past workout routines including a most recent level of resistance;

suggest that the user begin an upcoming workout routine at the stored most recent level of resistance;

track an amount of time that the user used the strength training apparatus; and receive from the user, and store, an age of the user, a height of the user, and a weight of the user.

68. The strength training apparatus of claim 48, wherein:

the electronic control panel further includes a radio communication link for communication with another device;

the strength training apparatus further comprises an application program configured to be loaded on the other device, the application program configured to:

display information regarding past workout routines performed by the user on the strength training apparatus;

display a schedule of customized workout routines for the strength training apparatus based on a stored physical fitness goal that was inputted by the user; and generate a custom workout routine for the strength training apparatus that includes sets and repetitions of an exercise that involves pulling on the first cable and/or the second cable.

* * * * *